US011638504B2

(12) United States Patent
Knauf et al.

(10) Patent No.: US 11,638,504 B2
(45) Date of Patent: May 2, 2023

(54) PAPER WRAPS, PAPER WRAPPED PRODUCTS, AND METHODS OF MAKING THE SAME

(71) Applicant: GPCP IP Holdings LLC, Atlanta, GA (US)

(72) Inventors: Gary H. Knauf, Bear Creek, WI (US); Cary Q. Peterson, Fond du Lac, WI (US); Taylor L. Sopata, Appleton, WI (US)

(73) Assignee: GPCP IP Holdings LLC, Atlanta, GA (US)

( * ) Notice: Subject to any disclaimer, the term of this patent is extended or adjusted under 35 U.S.C. 154(b) by 77 days.

(21) Appl. No.: 17/190,019

(22) Filed: Mar. 2, 2021

(65) Prior Publication Data

US 2021/0282604 A1 Sep. 16, 2021

Related U.S. Application Data

(60) Provisional application No. 63/140,084, filed on Jan. 21, 2021, provisional application No. 62/990,201, filed on Mar. 16, 2020.

(51) Int. Cl.
*A47K 10/16* (2006.01)
*D21H 27/00* (2006.01)

(52) U.S. Cl.
CPC ..... *A47K 10/16* (2013.01); *D21H 27/002* (2013.01)

(58) Field of Classification Search
CPC ..... A47K 10/16; D21H 27/002; D21H 21/16; D21H 21/18; D21H 27/10; B65D 65/14; B65D 75/08; B65D 71/06; B65D 71/12; B65D 71/36; B65D 71/40; B65D 71/46; B65D 75/00; B65D 75/02; B65D 75/04; B65D 75/06; B65D 75/12; B65D 75/14; B65D 75/18; B65D 75/52; B65D 71/063
See application file for complete search history.

(56) References Cited

U.S. PATENT DOCUMENTS 730,997 A 6/1903 Wheeler
1,702,276 A 2/1929 Shaffer et al.
(Continued)

FOREIGN PATENT DOCUMENTS

BR PI0400623 1/2005
BR PI0405362 7/2005
(Continued)

OTHER PUBLICATIONS

Abstract of JPH10286195A dated Oct. 27, 1998.
(Continued)

*Primary Examiner* — Eric Hug
*Assistant Examiner* — Matthew M Eslami

(57) ABSTRACT

The present disclosure provides paper wraps, paper wrapped products, such as rolled bath tissue, paper towel products, or bundles of rolled bath tissue or paper towels, and methods for covering a product or bundled products in a paper wrap. For example, printed paper wraps and their use are described, wherein the printed paper wraps comprise at least one heat-sealable adhesive that may be applied in varying locations, coverage levels, and patterns comprising different seal strengths, which may be sealed using heat and/or pressure external to the products for packaging and protective purposes.

26 Claims, 11 Drawing Sheets

(56) References Cited

U.S. PATENT DOCUMENTS

| | | | |
|---|---|---|---|
| 2,105,367 | A | 1/1938 | Parsons |
| 2,105,368 | A | 1/1938 | Parsons |
| 2,110,814 | A | 3/1938 | Parsons |
| 2,110,815 | A | 3/1938 | Parsons |
| 2,113,078 | A | 4/1938 | Campbell |
| 2,131,668 | A | 9/1938 | Parsons |
| 2,185,470 | A | 1/1940 | MacDonald et al. |
| 2,224,504 | A | 12/1940 | Milmoe |
| 2,301,016 | A | 11/1942 | Cannard |
| 2,363,751 | A | 11/1944 | Schultz et al. |
| 2,424,110 | A | 7/1947 | Morrison et al. |
| 2,673,430 | A | 3/1954 | Fleischer et al. |
| 2,690,838 | A | 10/1954 | Tepper |
| 2,992,117 | A | 7/1961 | Rosen et al. |
| 3,070,462 | A | 12/1962 | McConnell et al. |
| 4,595,093 | A | 6/1986 | Eckstein |
| 4,848,931 | A | 7/1989 | Kamada et al. |
| 4,858,762 | A | 8/1989 | Kewen |
| 5,753,895 | A | 5/1998 | Olson et al. |
| 5,775,056 | A | 7/1998 | Rauhala et al. |
| 5,987,847 | A | 11/1999 | Nordstrom et al. |
| 6,374,583 | B1 | 4/2002 | Daelmans et al. |
| 6,409,078 | B2 | 6/2002 | Varadarajan |
| 6,907,716 | B2 | 6/2005 | Cinotti et al. |
| 7,032,365 | B2 | 4/2006 | Cinotti |
| 7,155,883 | B2 | 1/2007 | Baldanza et al. |
| 7,174,697 | B2 | 2/2007 | Hada et al. |
| 7,913,895 | B2 | 3/2011 | Bowden et al. |
| 8,356,460 | B2 | 1/2013 | Bowden et al. |
| 9,994,376 | B2 | 6/2018 | de Soto-Burt et al. |
| D826,057 | S | 8/2018 | Joao do Silva Antunes da Guia |
| 2004/0226269 | A1 | 11/2004 | Cinotti et al. |
| 2005/0126116 | A1 | 6/2005 | Baldanza et al. |
| 2005/0132671 | A1 | 6/2005 | Cinotti |
| 2006/0013043 | A1 | 6/2006 | Hada et al. |
| 2006/0130435 | A1 | 6/2006 | Hada et al. |
| 2010/0181219 | A1* | 7/2010 | Eilert ..... B65D 75/5827 206/389 |
| 2015/0114866 | A1 | 4/2015 | de Soto-Burt et al. |
| 2016/0318681 | A1* | 11/2016 | Janardhana ..... D21H 27/10 |
| 2017/0029184 | A1* | 2/2017 | Hoffman ..... B65D 65/14 |
| 2021/0025114 | A1 | 1/2021 | Mongrain et al. |

FOREIGN PATENT DOCUMENTS

| | | |
|---|---|---|
| BR | PI0405364 | 7/2005 |
| BR | PI0519107 | 12/2008 |
| CA | 2177480 | 6/1995 |
| CA | 2456354 | 7/2004 |
| CA | 2488283 | 5/2005 |
| CA | 2488452 | 5/2005 |
| CA | 2925571 | 5/2015 |
| DE | 1446813 | 4/1969 |
| DE | 69416527 | 9/1999 |
| DE | 602005014669 | 9/1999 |
| DE | 60310952 | 11/2007 |
| DE | 60316817 | 7/2008 |
| EP | 0730547 | 9/1996 |
| EP | 1442984 | 8/2004 |
| EP | 1535843 | 6/2005 |
| EP | 1535844 | 6/2005 |
| EP | 1827984 | 9/2007 |
| EP | 3044115 | 7/2016 |
| ES | 2130566 | 7/1999 |
| ES | 2277054 | 7/2007 |
| ES | 2294261 | 4/2008 |
| ES | 2576427 | 7/2016 |
| ES | 2641667 | 11/2017 |
| FI | 93711 | 2/1995 |
| IL | 244717 | 5/2015 |
| JP | H09505544 | 6/1997 |
| JP | H10286195 A | 10/1998 |
| JP | 2011073693 | 4/2011 |
| JP | 5451293 | 3/2014 |
| JP | 2016539056 | 12/2016 |
| JP | 6189536 | 8/2017 |
| WO | WO95/14614 | 6/1995 |
| WO | WO2006/068666 | 6/2006 |
| WO | WO2015/065832 | 5/2015 |
| WO | WO2020216961 | 10/2020 |
| WO | WO2021009339 | 1/2021 |
| WO | WO2021009340 | 1/2021 |

OTHER PUBLICATIONS

Abstract of JP2011073693A dated Apr. 9, 2021.

"Ecova Heat-sealable Paper Overwrap on Infinity Packaging Line," Infinity Machine & Engineering Corporation (Mar. 9, 2020); https://www.youtube.com/watch?v=tHw4tKO5_Qo.

"Ecova Paper Wrap from Little Rapids Corporation on the Infinity Eclipse T4 Multi-pack Wrapper," Infinity Machine & Engineering Corp., May 2020, https://www.papnews.com/insight/ecova-paper-wrap-from-little-rapids-corporation-on-the-infinity-eclipse-t4-multi-pack-wrapper/.

"Henkel enables recyclable paper packaging with new Loctite Liofol HS 2809-22 RE," May 12, 2020, www.henkel.com.

"Kimberly-Clark releases first FSC certified 100% bamboo product," Tissue Online, Feb. 9, 2021, https://tissueonlinenorthamerica.com/kimberly-clark-releases-first-fsc-certified-100-bamboo-product/.

Holmer, "Ecova—Helping to Create a Plastic-Free Line at High Speeds of 100PPM," *Tissue World Magazine*, May/Jun. 2020, Issue No. 3, pp. 34-35.

International Search Report and Written Opinion of the International Searching Authority that dated Jul. 28, 2021 in PCT/IB2021/051861, 29 pages.

* cited by examiner

PAPER WRAPS, PAPER WRAPPED PRODUCTS, AND METHODS OF MAKING THE SAME

CROSS REFERENCE TO RELATED APPLICATIONS

This application is based on U.S. Provisional Patent Application No. 62/990,201, filed Mar. 16, 2020, and U.S. Provisional Patent Application No. 63/140,084, filed Jan. 21, 2021, both of which are hereby incorporated by reference in their entirety.

TECHNICAL FIELD

The present disclosure provides paper wraps, paper wrapped products, such as rolled bath tissue, paper towels, or bundles of rolled bath tissue or paper towel products, and methods for covering such products in a paper wrap. For example, printed paper wraps and their use are described, wherein the printed paper wraps comprise at least one heat-sealable adhesive that may be applied in varying locations, coverage levels, and patterns comprising different seal strengths, which may be sealed using heat and/or pressure external to the products for packaging and protective purposes.

BACKGROUND

Paper wraps are known to be useful in protecting various products, for example, individually rolled bath tissue products used in hotels, office buildings, and the like. In such instances, paper wraps are conventionally manufactured to be wrapped around the bath tissue product with a core, wherein the excess wrapping on the ends is twisted and tucked into the core to stay in place. These cores are typically at least two inches in diameter. However, in the case of "coreless" paper products, there is no core sufficient to tuck excess paper into, so such paper wraps cannot be used to protect these rolled tissue products using conventional wrapping methods. The hole in the middle of rolled coreless paper products is typically less than one inch in diameter, thus there is not sufficient space in which to tuck excess paper wrapping.

It is, therefore, desirable to develop a paper wrap which stays securely wrapped around a paper product, for example a coreless paper product, to protect the product, without needing to twist and tuck the paper wrap into a core to stay in place. Relatedly, the paper wrap must also be able to be easily removed by consumers for their use. Thus, while the paper wrap must be securely sealed around the product, the seal should not be so secure that it is difficult for consumers to remove.

Paper wraps may also be used in the protection of bundled products, for example bundles of bath tissue or bundles of paper towels. The use of paper wraps for bundled bath tissue or paper towels is more environmentally friendly than the widely used plastic or poly film wraps currently in use for such bundled products. Paper wrap technology for bundled bath tissue has seen some interest in, e.g., Europe, due to an increased desire for sustainable solutions to replace plastics. However, current paper wraps for bundled bath tissue often tear open easily when the bundle is dropped, and thus they do not securely hold the products in place when transported or stored.

It is, therefore, also desirable to develop a paper wrap which stays securely wrapped around bundled products, for example, a bundle of bath tissue rolls or paper towel rolls, to protect the products, without tearing open easily upon dropping the bundle. Relatedly, the paper wrap must also be able to be easily removed by consumers for their use. Current plastic or poly film wraps for bundled bath tissue are often difficult for consumers to open, since the plastic is often melted to itself and must be aggressively torn apart or punctured in order for consumers to open the package. Thus, while the paper wrap must be securely sealed around the bundle, the seal should not be so secure that it is difficult for consumers to remove.

Moreover, the paper wrapped products must also be able to be transported, for example in bulk on pallets in trucks, where the individual or bundled products are typically stacked one on top of the other in varying temperatures. Where adhesives are used to secure the paper wrap around the product, it is therefore desirable that the adhesive keep the paper wrap secured on an individual or bundled product, without sticking one product (or bundled product) to another. This sticking of one product to another when paper wrapped products are stacked on top of each other is called "blocking" and should be minimized. The products should also be wrapped in a manner to minimize adhering the wrap to the product itself in a way that causes damage or tearing to the product (or bundled product) when the wrap is removed.

The present inventors have surprisingly designed paper wrapped products, and methods of wrapping an individual or bundled product in a paper wrap, wherein the paper wraps have enough seal strength to secure and protect the product but need not be twisted and tucked into a core of the product to stay in place, are easily opened in one piece, and are resistant to blocking and damage to the product during removal.

SUMMARY

Embodiments disclosed herein provide inventive paper wrapped products, wherein the paper wrap is coated with at least one adhesive that will seal to itself, another adhesive, or to the paper wrap to secure the paper wrap around the product, without the paper wrap needing to be twisted and tucked into a core of the product to stay in place. Without wishing to be bound by theory, it is believed that, by selectively applying adhesive to the outside surface of a paper wrap in varying patterns and levels of coverage described herein, and by folding the paper wrap to cover the product such that the adhesive contacts and binds to itself, another adhesive, and/or the paper wrap, the overall performance of the paper wrapped product can be improved. Selective adhesive coverage to the outside surface of a paper wrap will not only result in cost savings but will also decrease the potential for blocking and damage to the product.

Embodiments disclosed herein also provide inventive paper wrapped products, wherein the products can be opened without frustration, but wherein the paper wrap has sufficient seal strength to prevent unintentional tearing or tampering. The inventive paper wrapped products disclosed herein are also more environmentally friendly than the widely used plastic or poly film paper wraps. In some embodiments, it is believed that, by selectively applying adhesive to both the outside surface of a paper wrap and the inside surface of a paper wrap, and by folding the paper wrap to cover the product such that the adhesive contacts and binds to itself, another adhesive, and/or the paper wrap, the overall performance of the bundled product can be improved.

The present application further discloses methods of making improved paper wrapped products, which paper wraps exhibit excellent seal strength, cost savings, and decreased blocking.

Figure 1A:
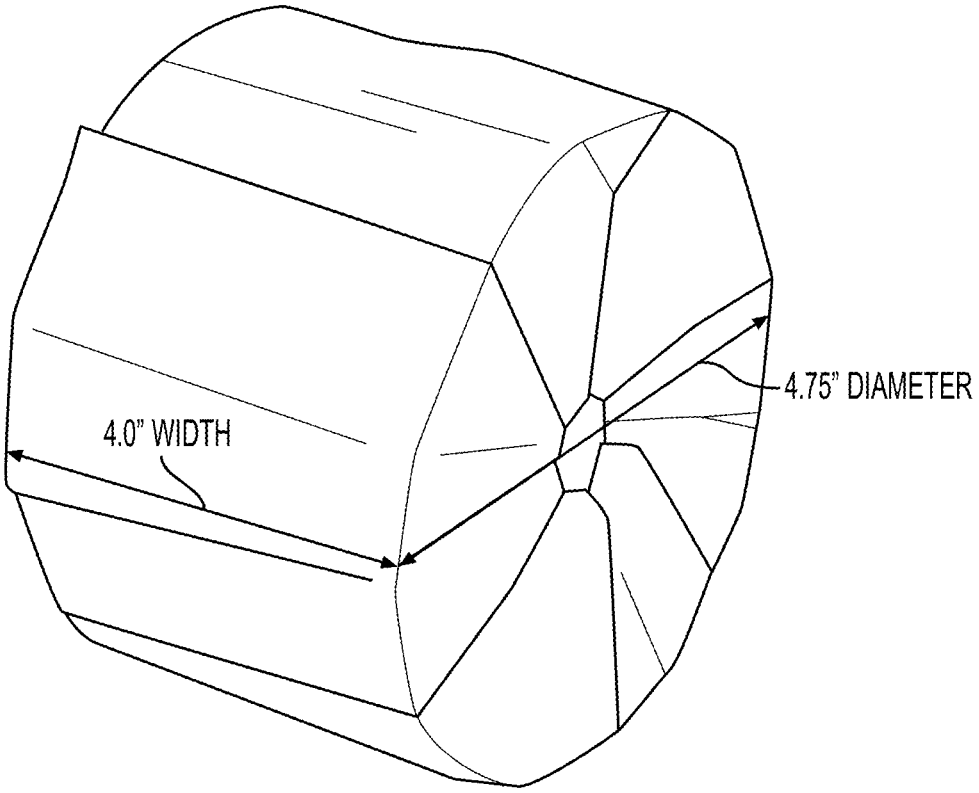
FIG. 1A depicts an exemplary paper wrapped coreless bath tissue roll with a 4.0" width and a 4.75" outside diameter ("OD").
Figure 1B:
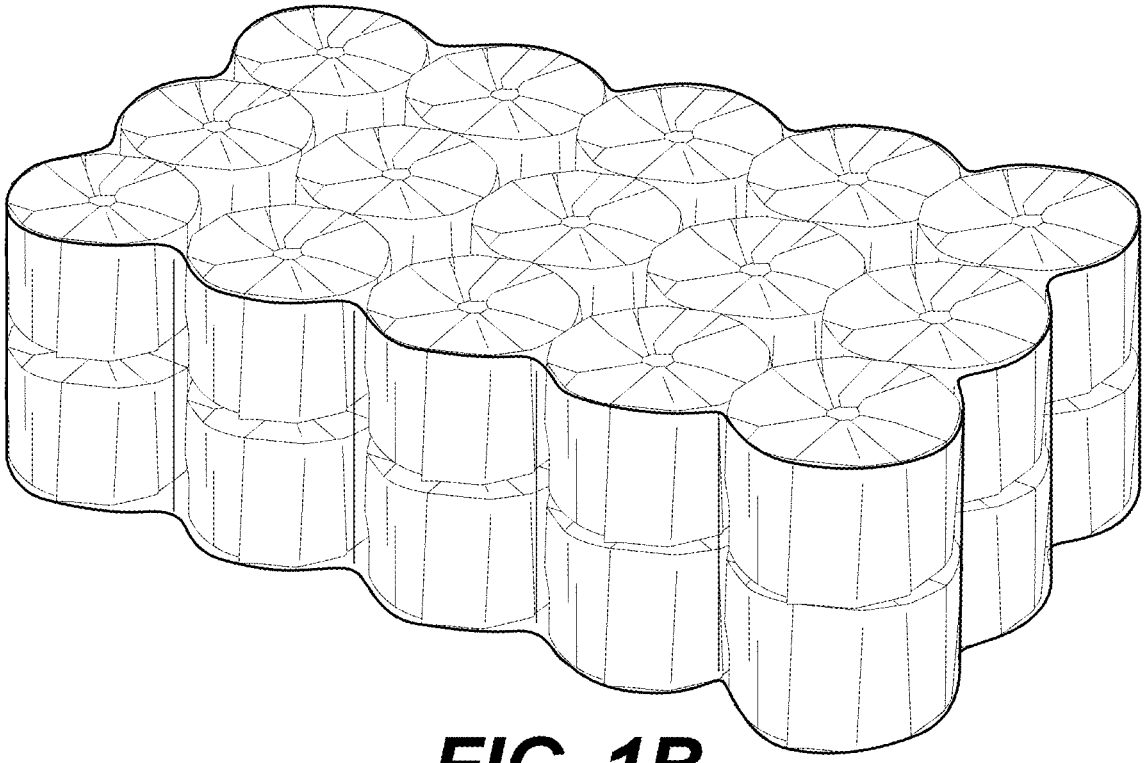
FIG. 1B depicts how individually wrapped rolled paper products could be stacked together for transport.

All measurements shown in the Figures for the dimensions and geometries of the exemplary products, wraps, and adhesive coverage patters are exemplary only and are not limiting on the possible lengths and geometries covered by the present invention.

DETAILED DESCRIPTION

The paper wrapped products according to the present disclosure have a top surface, a bottom surface, and at least one side surface. As used herein, the term "paper wrapped product" may refer to an individually wrapped item or a group of items, such as a bundle of items covered by a single paper wrap. As used herein, the term "top surface" refers to the surface of the product that faces upwards when the product is placed on a platform, such as a pallet to be transported. Conversely, the term "bottom surface" refers to the surface of the product that faces downwards when the product is placed on a platform, such as a pallet to be transported. In some embodiments, the product may be symmetrical such that the top and bottom surfaces are opposite one another, but are identical, such as in a roll product. In the example of a roll product, the top and bottom surfaces are symmetrical and may also be referred to as the "ends." The term "side surface" refers to any surface of the paper wrapped product that is positioned in between the top surface and the bottom surface. In the example of a roll product, the side surface constitutes the curved portion that lies in between the symmetrical top and bottom surfaces and may also be referred to as the "belly." As used herein, the term "bundle" refers to a group of items, which are stacked together and are covered by a single paper wrap. For example, a bundle may include parallel stacks of items, such as rolls, wherein the stacks of rolls are covered by a single paper wrap. In the example of a bundle of rolls, the top and bottom surfaces of each bundle may be symmetrical, and the top and bottom surfaces of the bundle of products may also be referred to as the "ends." The side surface of the bundle constitutes the curved portions of the stacked roll products in between the symmetrical top and bottom surfaces of the roll products and may also be referred to as the "belly."

The paper wrap according to the present disclosure is a planar sheet having a first surface and a second surface. When wrapped around a product, the first surface may be referred to as the outside surface and the second surface may be referred to as the inside surface. As used herein, the "inside surface" is defined as the surface of the paper wrap that primarily faces towards the product when wrapped around the product. Conversely, as used herein, the "outside surface" is defined as the surface of the paper wrap that primarily faces outward and away from the paper product when wrapped around the product.

The paper wrap may be made of any known material comprising a majority portion derived from cellulosic pulp. In some embodiments, chemical wood pulps may be used. In other embodiments mechanical wood pulps may be used. In some embodiments, the paper wrap may be a coated paper wrap, wherein one or both sides are coated with a mineral or pigment, for example clay, kaolin, calcium carbonate, bentonite, and/or talc. In some embodiments, the paper wrap may comprise kraft fiber wood pulps. In some embodiments, the kraft fiber may be bleached or unbleached kraft fiber. In some embodiments, the paper wrap may contain from 0-100% recycled fiber content, for example at least about 15%, at least about 25% or at least about 40% recycled fiber. In some embodiments, the basis weight of the paper wrap can range from about 9 lb/3000 $ft^2$ to about 50 lb/3000 $ft^2$. In some embodiments, for example wherein the products are individually wrapped items, the basis weight of the paper wrap can range from about 9 lb/3000 $ft^2$ to about 25 lb/3000 $ft^2$, for example, from about 12 lb/3000 $ft^2$ to about 20 lb/3000 $ft^2$, or from about 14 lb/3000 $ft^2$ to about 16 lb/3000 $ft^2$. In some embodiments, for example wherein the products are bundled items, the basis weight of the paper wrap can range from about 15 lb/3000 $ft^2$ to about 50 lb/3000 $ft^2$, for example, from about 20 lb/3000 $ft^2$ to about 30 lb/3000 $ft^2$, for example from about 23 lb/3000 $ft^2$ to about 27 lb/3000 $ft^2$. In some embodiments, the paper wrap may be a printed paper wrap, meaning that it contains decorative elements, patterns, or informational markings, such as text or eye marks, on the outside surface. As used herein, the term "eye mark" means a small identifying mark, such as a rectangular printed area located near the edge of the printed paper wrap, that may be used to locate and/or position the paper sheet during manufacture or processing.

According to the present disclosure, the paper wrap is folded to cover the product such that portions of the outside surface of the paper wrap are folded back to overlay other portions of the outside surface of the paper wrap. As used herein, the term "folded back to overlay" means folded back such that one portion of the outside surface of the paper wrap directly contacts another portion of the outside surface in a face-to-face configuration.

In some embodiments, the paper wrap is folded to cover the product such that a first portion of the outside surface of the paper wrap is folded back at least once to overlay a second portion of the outside surface of the paper wrap at a position covering the top surface of the product; a third portion of the outside surface of the paper wrap is folded back at least once to overlay a fourth portion of the outside surface of the paper wrap at a position covering the bottom surface of the product; and a first portion of the inside surface of the paper wrap overlays a fifth portion of the outside surface of the paper wrap at a position covering the at least one side surface of the product. In this way, when wrapped around the product, the paper wrap has portions overlapping itself at each of the top surface, the bottom surface, and at least one side surface. This configuration may be seen in FIGS. 1A, 2A, 2B, 16 and 17.

According to the present disclosure, portions of the outside surface of the paper wrap are coated with at least one adhesive. In some embodiments, at least one first adhesive is coated onto at least one of the first or second portions of the outside surface of the paper wrap and at least one second adhesive is coated onto at least one of the third or fourth portions of the outside surface of the paper wrap such that, when wrapped around the product, the first and second portions of the outside surface are bonded together by the at least one first adhesive and the third and fourth portions of the outside surface of the paper wrap are bonded together by the at least one second adhesive. In this way, when wrapped around the product, the paper wrap has portions bonded together at each of the top surface and the bottom surface of the product. In some embodiments, the fifth portion of the outside surface of the paper wrap is also coated with at least one third adhesive such that, when wrapped around the product, the at least one third adhesive bonds to the corresponding first portion of the inside surface of the paper wrap. In this way, when wrapped around the product, the paper wrap has portions bonded together at each of the top, bottom, and side surfaces of the product. The configurations above allow the paper wrap to secure itself around the product, without needing to be twisted and tucked into a core of the product to stay in place.

In some embodiments, each of the first and second portions of the outside surface of the paper wrap are coated with the at least one first adhesive and each of the third and fourth portions of the outside surface of the paper wrap are coated with the at least one second adhesive such that, when wrapped around the product, the first and second portions of the outside surface of the paper wrap are bonded together by an adhesive-to-adhesive bond and the third and fourth portions of the outside surface of the paper wrap are bonded together by an adhesive-to-adhesive bond.

In some embodiments, the first portion of the inside surface of the paper wrap may also be coated with an adhesive such that, when wrapped around the product, the first portion of the inside surface of the paper wrap and the fifth portion of the outside surface of the paper wrap are bonded together by an adhesive-to-adhesive bond at a position covering the at least one side surface of the product. In an alternative embodiment, a sixth portion of the outside surface of the paper wrap may be coated with an adhesive and folded back to overlay the fifth portion of the outside surface of the paper wrap at a position covering the at least one side surface of the product in order to form an adhesive-to-adhesive bond at a position covering the at least one side surface of the product.

Figure 2A:
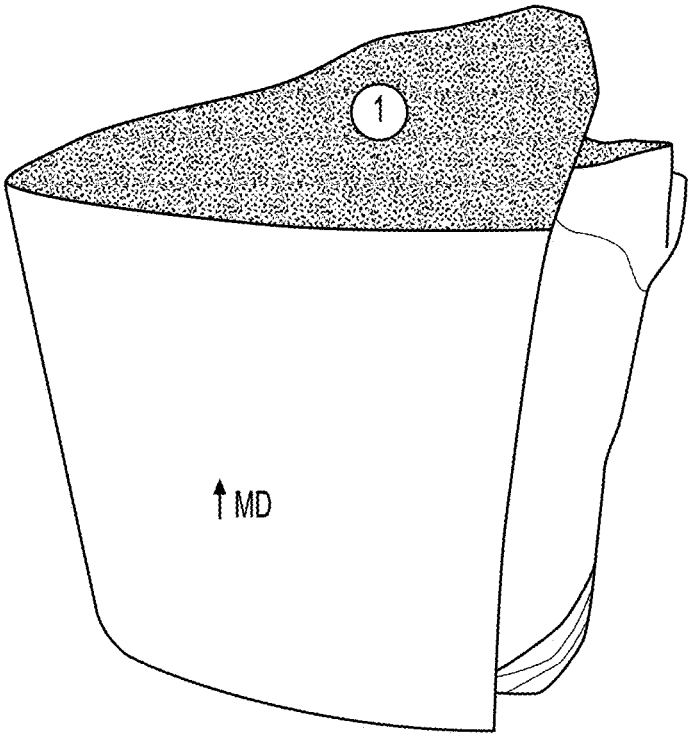
FIG. 2A depicts a side view of an exemplary individually wrapped coreless bath tissue roll, wherein the areas of the outside surface of the paper wrap that remained exposed on the outside surface of the product were marked in a spotted pattern.
Figure 2B:
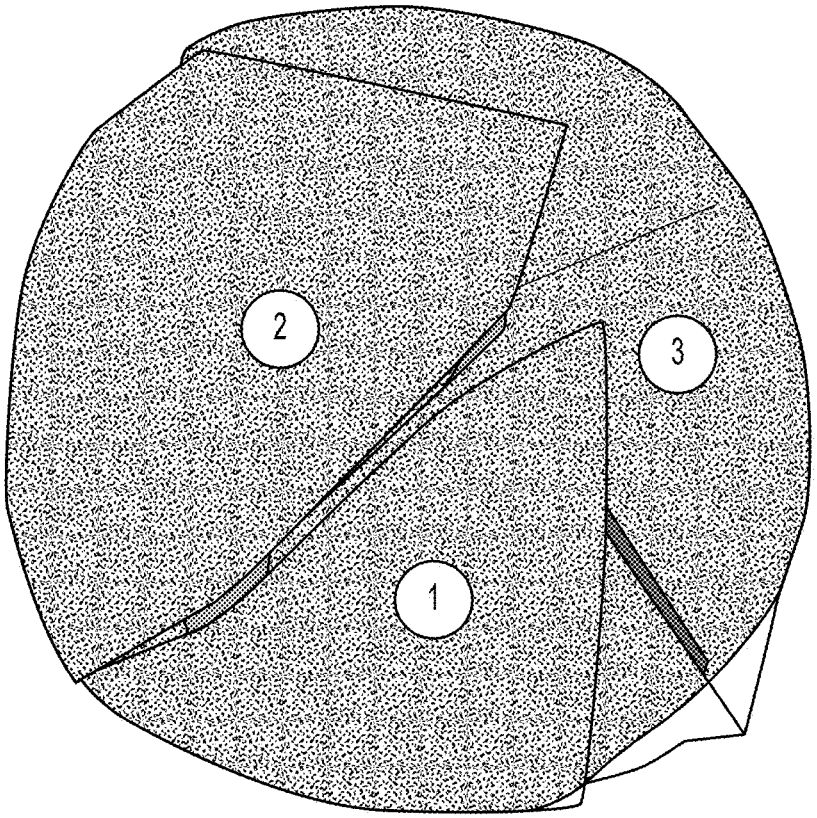
FIG. 2B depicts an overhead view of the paper wrapped rolled tissue product from FIG. 2A, showing one exemplary method of folding the paper wrap over the top of the product.
Figure 2C:
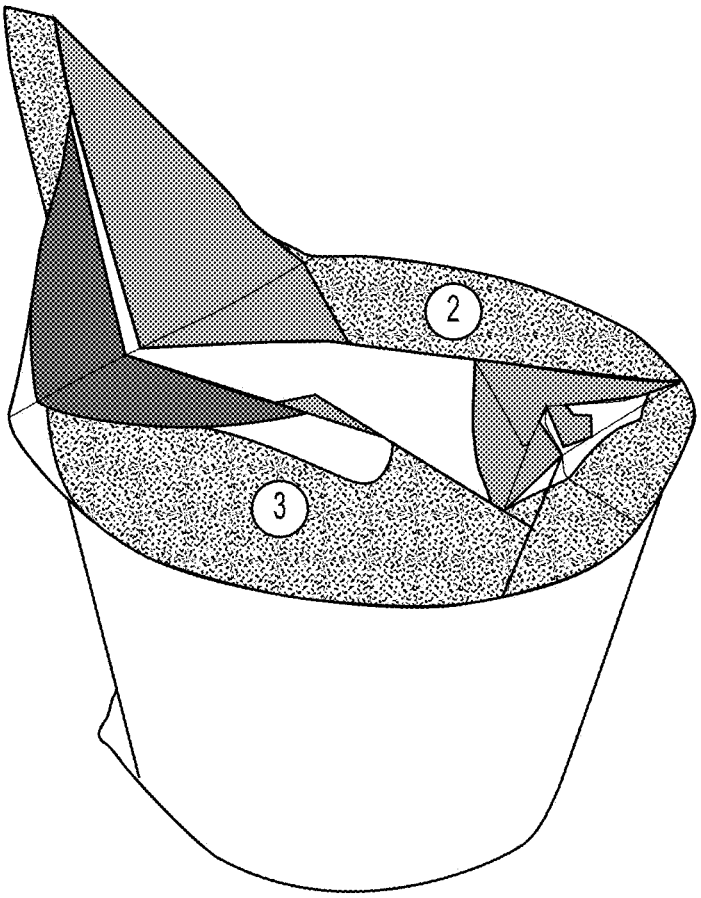
FIG. 2C depicts another view of the paper wrapped rolled tissue product from FIG. 2A, where the paper wrap has been partially unwrapped from the top of the product and where the areas of the outside surface of the paper wrap that were folded back and overlaid with other portions of the outside surface of the paper wrap were marked in a light gray solid pattern and a dark gray solid pattern.
Figure 2D:
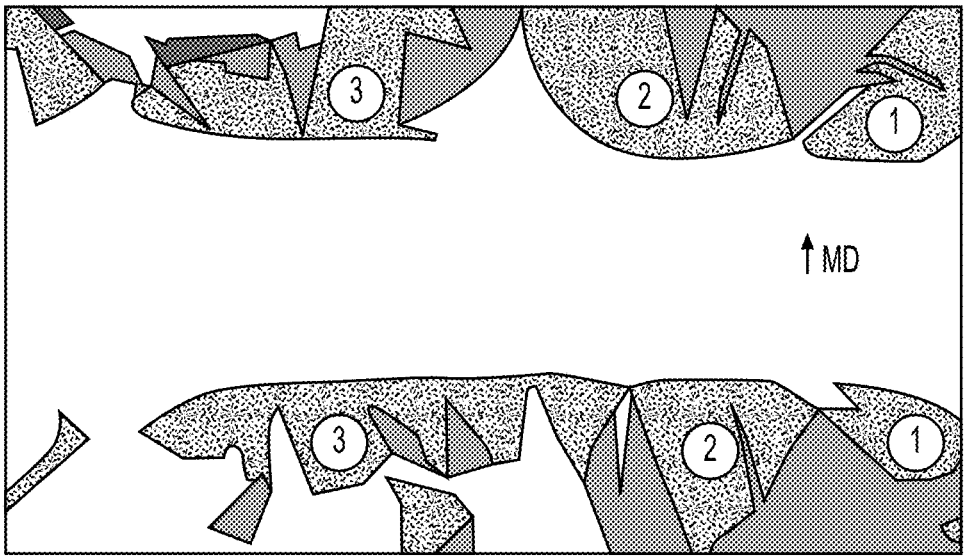
FIG. 2D depicts the outside surface of the paper wrap from FIGS. 2A-2C unwrapped and laid flat.
Figure 3:
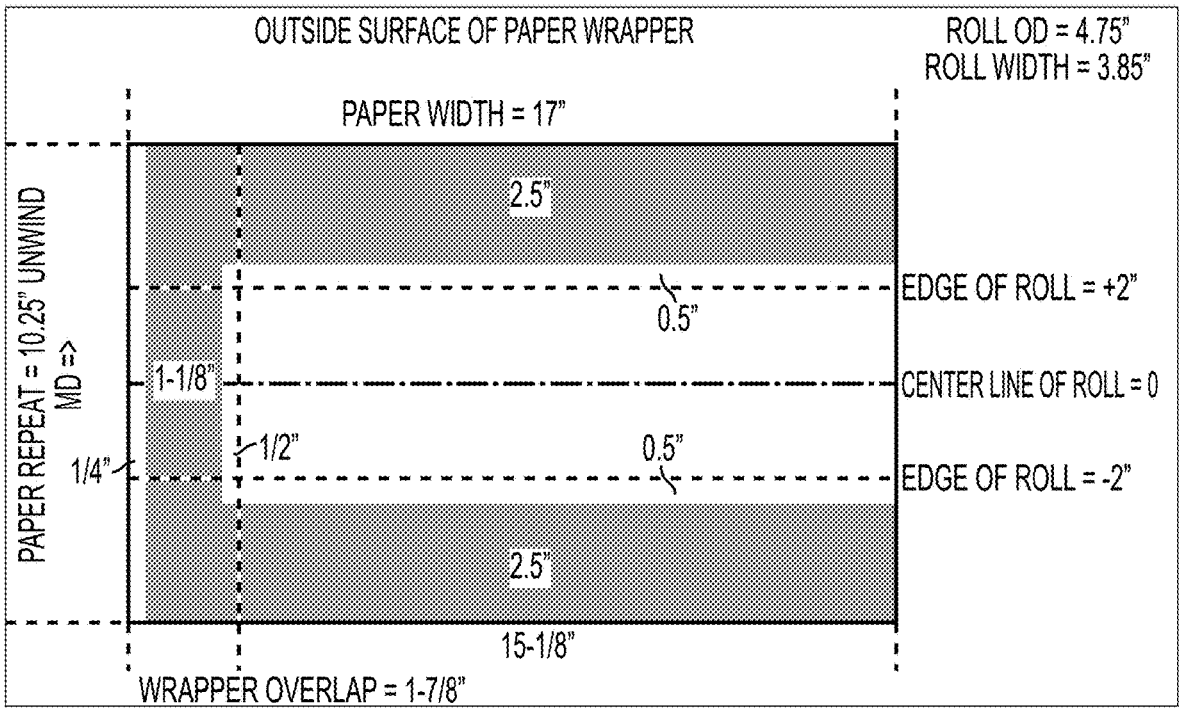
FIG. 3 depicts an exemplary adhesive configuration on the outside surface of a paper wrap for an individually wrapped item according to the present invention using a single adhesive applied in a vertical line corresponding to the area that forms the belly seal and applied in two horizontal lines corresponding to the areas that form the end seals.
Figure 4:
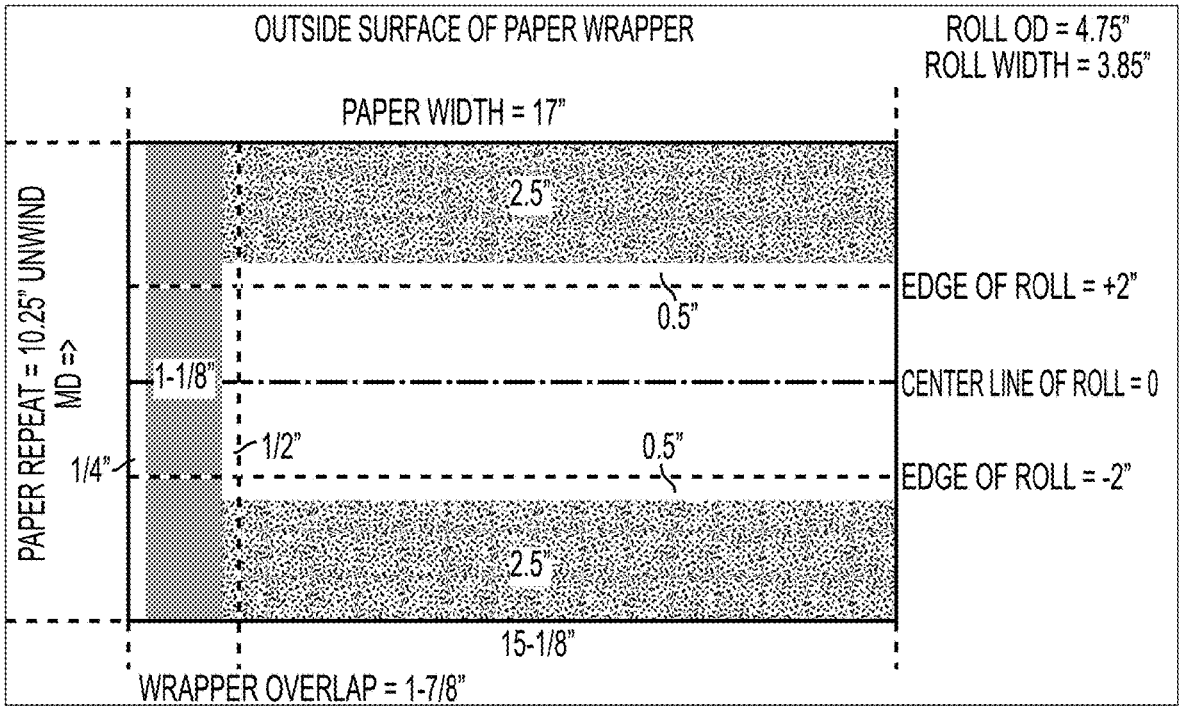
FIG. 4 depicts an exemplary adhesive configuration on the outside surface of a paper wrap for an individually wrapped item according to the present invention using two different adhesives shown by different shading in the areas corresponding to the belly and end seals.

FIGS. 2A-2C depict a paper wrap in various stages of being wrapped around a rolled tissue product, marked to indicate areas of the outside surface of the paper wrap that remain exposed on the outside of the product after wrapping and areas of the outside surface of the paper wrap that are folded back to overlay other areas of the outside surface of the paper wrap after wrapping. In the depicted embodiments, the areas marked in a spotted pattern were determined to be areas of the outside surface of the paper wrap that remain exposed on the outside of the product after wrapping, where no adhesive is needed. The areas marked with either a light gray or dark gray solid pattern were determined to comprise the portions of the outside surface of the paper wrap that folded back to overlay other portions of the outside surface of the paper wrap after wrapping, corresponding to said first and second portions or said third and fourth portions of the outside surface of the paper wrap described above, where adhesive may be applied to form a bond. FIG. 2D shows the same paper unwrapped and laid flat to show, for example, where the adhesive may be applied to the wrap prior to folding to form such adhesive bonds.

Figure 9:
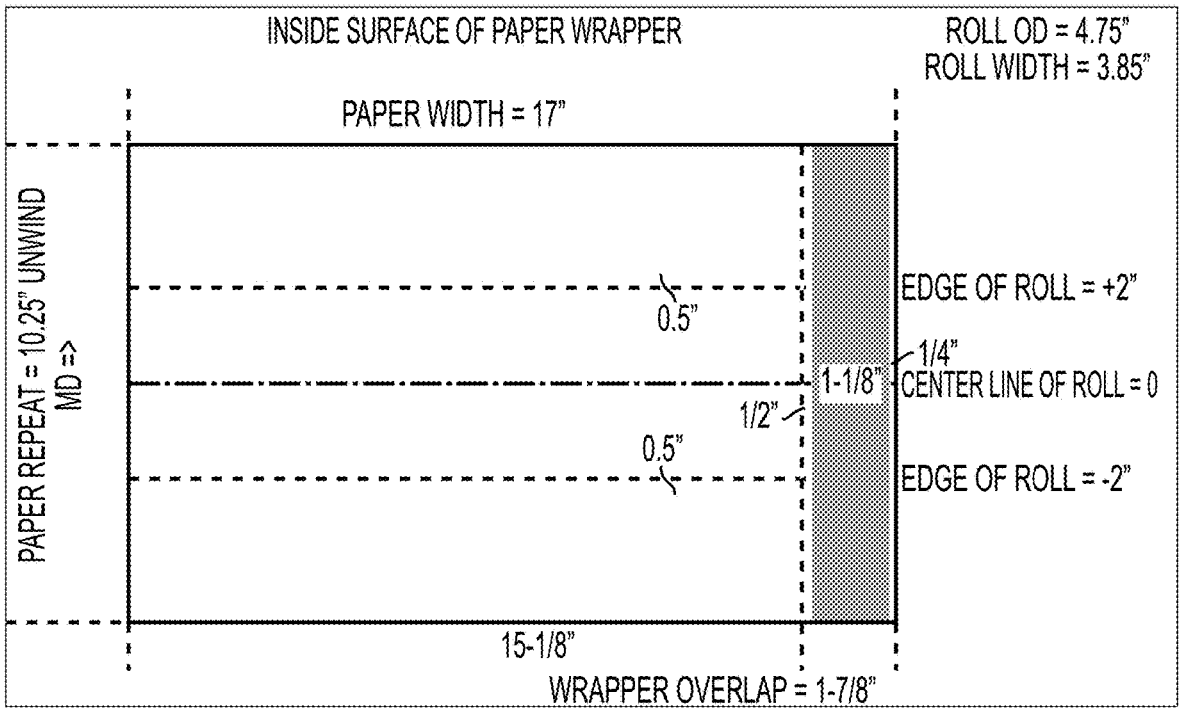
FIG. 9 depicts an exemplary adhesive configuration on the inside surface of a paper wrap for an individually wrapped item according to the present invention having adhesive applied in a vertical line in the area corresponding to the belly seal.
Figure 10:
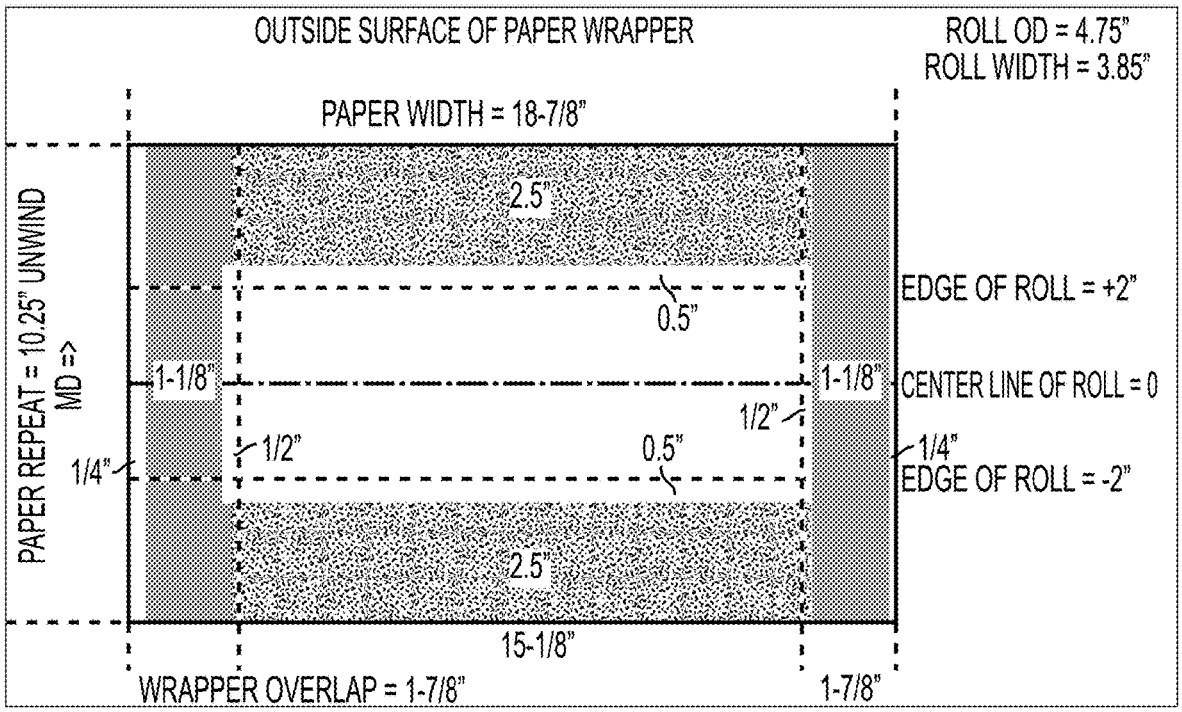
FIG. 10 depicts an exemplary adhesive configuration on the outside surface of a paper wrap for an individually wrapped item according to the present invention using two different adhesives shown by the different shading and having one adhesive applied in two vertical lines for the areas corresponding to the belly seal and one adhesive applied in two horizontal lines corresponding to the areas that form the end seals after folding one edge back on itself during wrapping.
Figure 11:
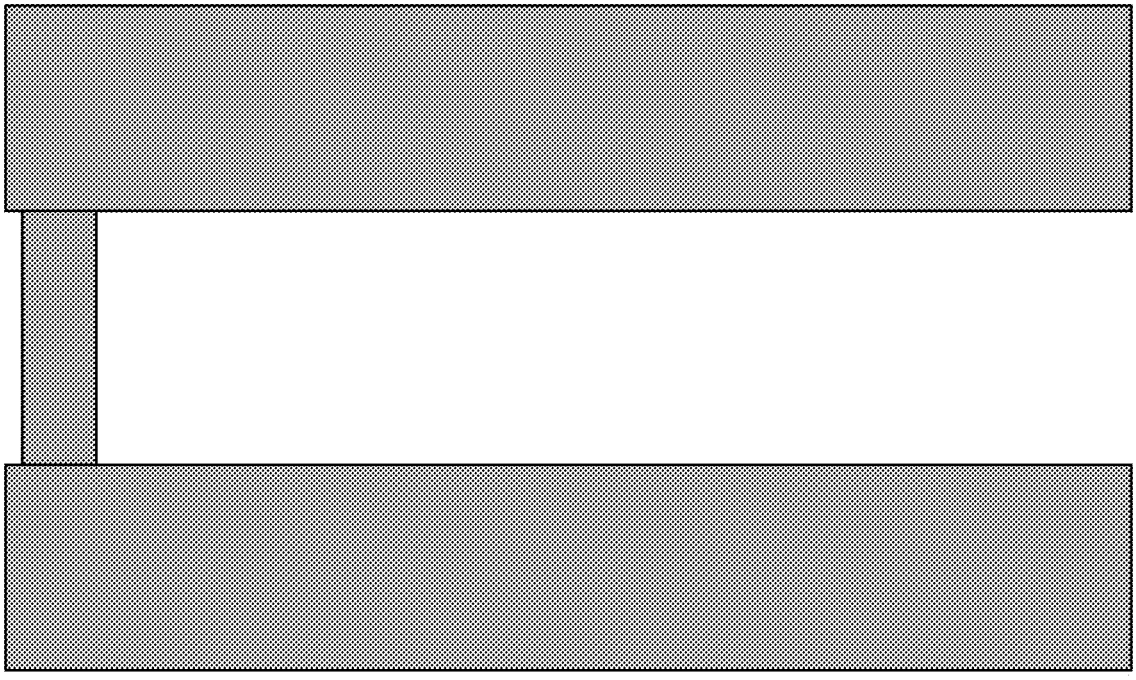
FIG. 11 depicts an exemplary embodiment of a paper wrap according to the present invention having adhesive applied in a vertical line in a 100% coverage pattern corresponding to the area that forms the belly seal and in two horizontal lines in a 100% coverage pattern corresponding to the areas that form the end seals.
Figure 12:
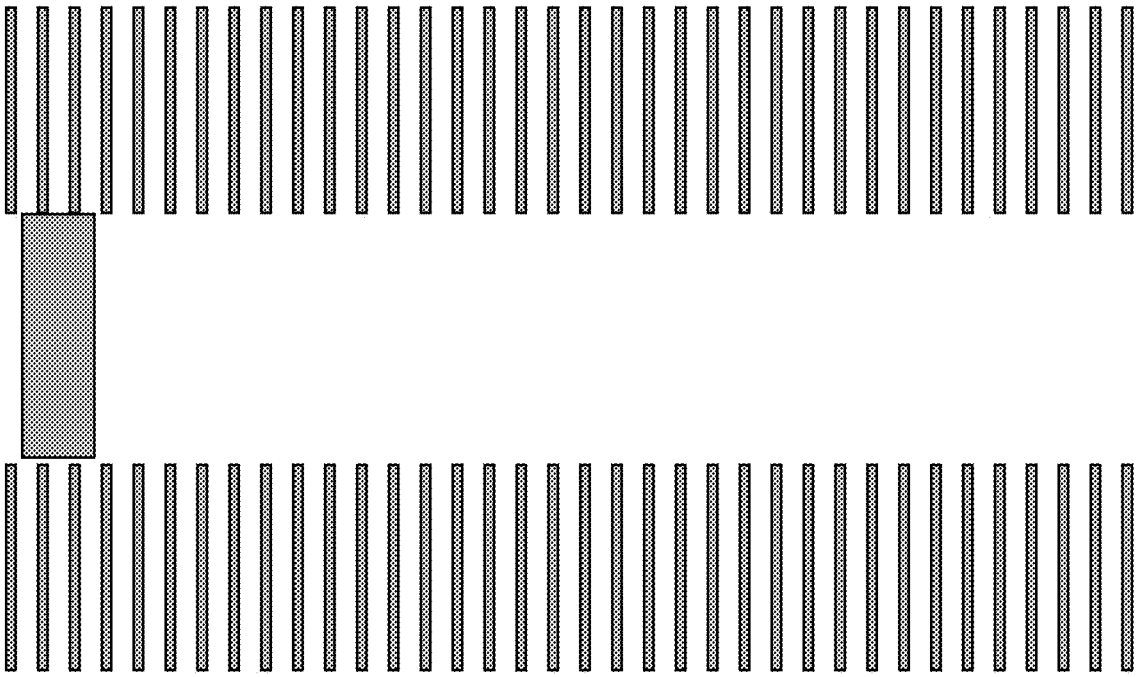
FIG. 12 depicts an exemplary embodiment of a paper wrap according to the present invention having adhesive applied in a vertical line in a 100% coverage pattern corresponding to the area that forms the belly seal and in two horizontal lines in a 50% coverage striped pattern corresponding to the areas that form the end seals.
Figure 13:
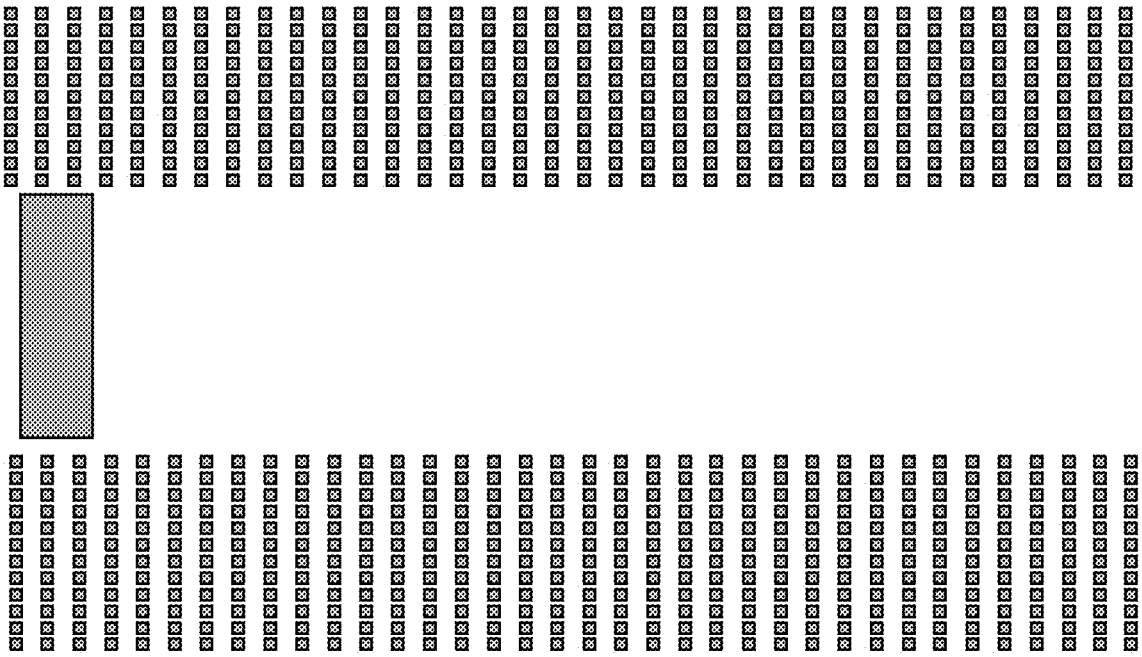
FIG. 13 depicts an exemplary embodiment of a paper wrap according to the present invention having adhesive applied in a vertical line in a 100% coverage pattern corresponding to the area that forms the belly seal and in two horizontal lines in a 25% coverage square pattern corresponding to the areas that form the end seals.
Figure 14:
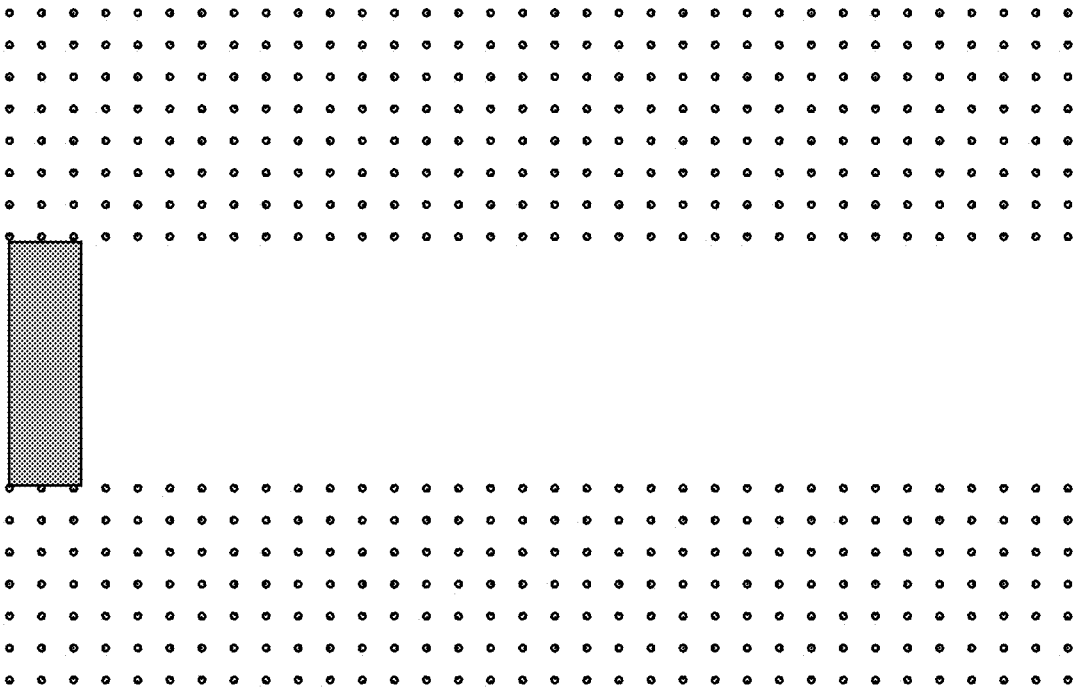
FIG. 14 depicts an exemplary embodiment of a paper wrap according to the present invention having adhesive applied in a vertical line in a 100% coverage pattern corresponding to the area that forms the belly seal and in two horizontal lines in a 7% coverage dot pattern corresponding to the areas that form the end seals.

FIGS. 3-8 depict various exemplary geometries of how adhesive may be applied to the outside surface of the paper wrap before folding and wrapping around a product according to the present invention. The horizontal solid shaded areas correspond to areas where adhesive may be applied to the paper wrap to form the end seals upon wrapping (comprising said "first," "second," "third," and "fourth" portions of the outside surface of the paper wrap described above). The vertical solid shaded portions correspond to areas where adhesive may be applied to the paper wrap to form the belly seal upon wrapping (comprising said "fifth" portion of the outside surface of the paper wrap described above). FIG. 9 depicts an exemplary geometry of how adhesive may be applied to the inside surface of the paper wrap having a vertical solid shaded area comprising said "first portion of the inside surface of the paper wrap" forming the belly seal described above in some embodiments. In some alternative embodiments, the entire inside surface of the paper wrap may also be coated in an adhesive. The configuration of the inside surface of the paper wrap may be combined with any of the configurations of the outside surface of the paper wrap, including those shown in FIGS. 3-8. FIG. 10 depicts an exemplary geometry of how adhesive may be applied to the outside surface of the paper wrap having horizontal solid shaded areas corresponding to areas where adhesive may be applied to the paper wrap to form the end seals upon wrapping (comprising said "first," "second," "third," and "fourth" portions of the outside surface of the paper wrap described above) and vertical solid shaded areas corresponding to areas where adhesive may be applied to the paper wrap to form the belly seals upon wrapping (comprising said "fifth" and "sixth" portions of the outside surface of the paper wrap described above). While the dimensions depicted in FIGS. 3-10 are exemplary for an individually wrapped bath tissue product, the same exemplary adhesive application geometries may also be useful in other types of individual or bundle wrapped products of different dimensions. Other geometries may also be used in addition to those depicted in FIGS. 3-10.

Figure 16:
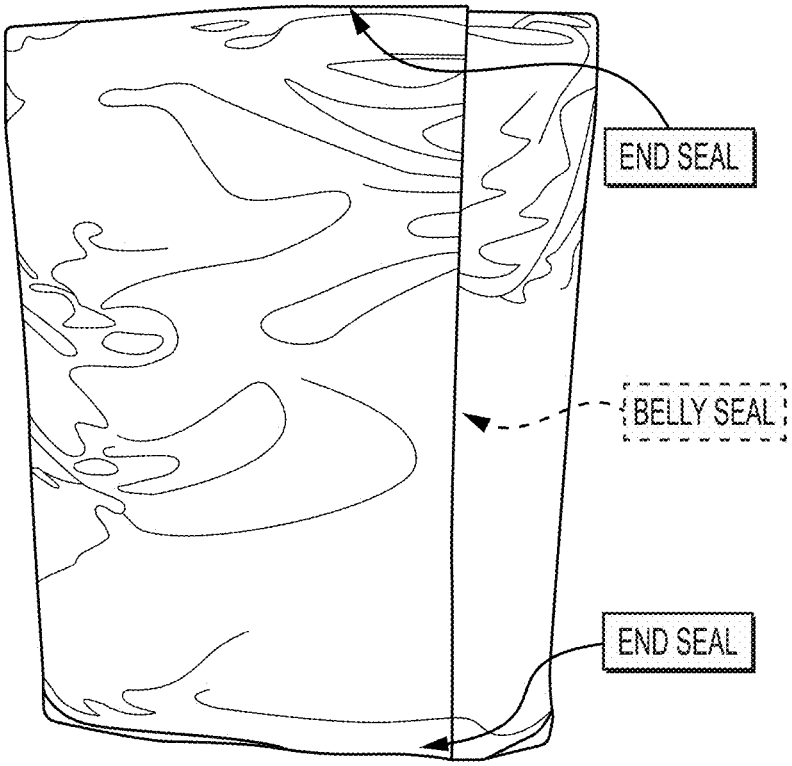
FIG. 16 depicts a side view of an exemplary paper wrapped bundle of rolled bath tissue, wherein the wrap consists of two end seals and a side (belly) seal.
Figure 17:
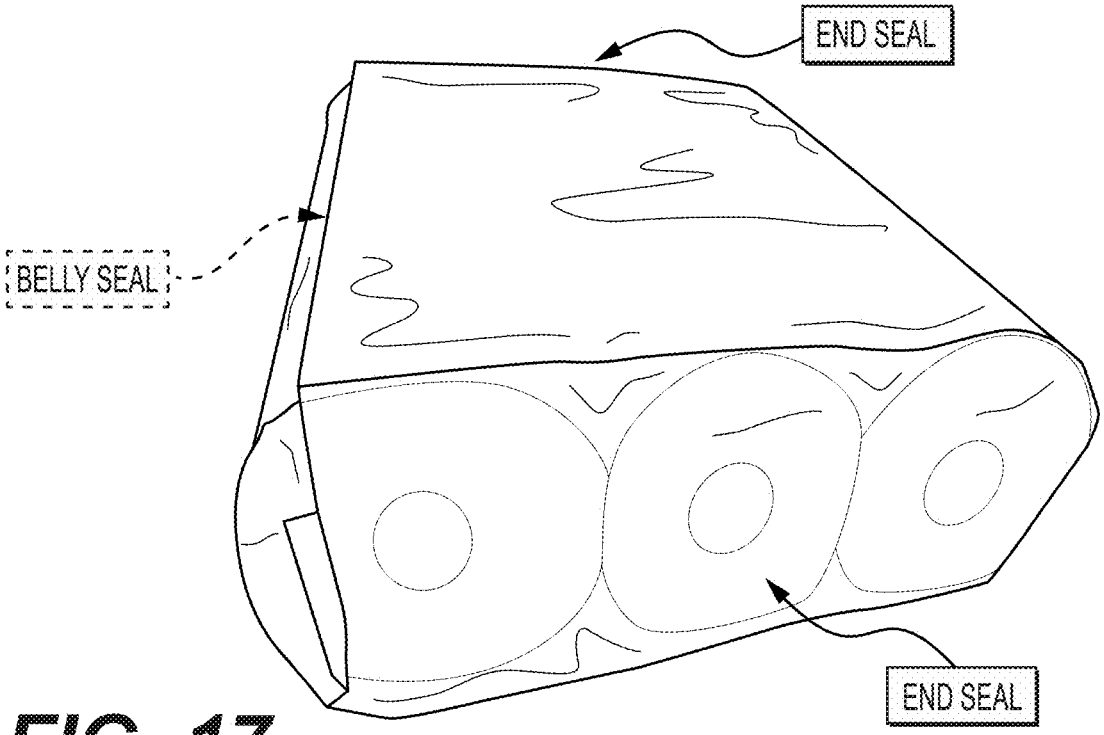
FIG. 17 depicts an overhead view of an exemplary paper wrapped bundle of rolled bath tissue, wherein the wrap consists of two end seals and a side (belly) seal.

The paper wrapped product may be any product of any shape. The paper wrapped product may be either a single item or a grouping of items, such as a bundle. In some embodiments, the paper wrapped product may comprise at least one roll-shaped product. In some embodiments, the paper wrapped product may comprise at least one paper towel roll. In some embodiments, the paper wrapped product may comprise at least one bath tissue roll. In some embodiments, the paper wrapped product is an individually wrapped paper towel roll. In some embodiments, the paper wrapped product is an individually wrapped bath tissue roll. In some embodiments, the paper wrapped product may comprise a bundle of roll-shaped products. In some embodiments, the paper wrapped product is a wrapped bundle of bath tissue rolls, for example a bundle of cored or coreless bath tissue rolls. FIGS. 16 and 17 depict examples of side and overhead views of an exemplary paper wrapped bundle of rolled bath tissue, wherein the wrap consists of two end seals and a side (belly) seal. In some embodiments, the paper wrapped product is a wrapped bundle of paper towel rolls, for example a bundle of cored or coreless paper towel rolls.

In some embodiments, the paper wrapped product comprises at least one coreless roll. In some embodiments, the paper wrapped product comprises a coreless bath tissue roll. In some embodiments, the paper wrapped product is an individually wrapped coreless bath tissue roll. In some embodiments, the paper wrapped product comprises a coreless paper towel roll. In some embodiments, the paper wrapped product is an individually wrapped coreless paper towel roll. In some embodiments, the paper wrapped product is a wrapped bundle of coreless bath tissue rolls. In some embodiments, the paper wrapped product is a wrapped bundle of coreless paper towel rolls. As used herein, the term "coreless" roll means a roll product that either does not have a through-hole extending from the top surface to the bottom surface or contains a through-hole extending from the top surface to the bottom surface that is less than about one inch in diameter. For example, in the case of a paper towel roll or bath tissue roll, a cored product contains a through-hole with a core (such as a cardboard or hardened core) that is over one inch in diameter and is intended to receive a dispenser rod for supporting the roll when in use. In contrast, a coreless paper towel roll or coreless bath tissue roll does not comprise a cardboard core or hardened core that is over one inch in diameter.

According to the present invention, the adhesive coating applied to either the outside surface or the inside surface of the paper wrap may be any type of adhesive coating capable of bonding to either the paper wrap or to itself, or both, or another adhesive. In some embodiments, the adhesive coating may be a water-resistant coating. In some embodiments, the adhesive coating may be an antimicrobial coating. In some embodiments, the adhesive coating may be heat sealable. In some embodiments, the adhesive coating may be a cold seal adhesive. In some embodiments, the adhesive coating may be heat resistant. In some embodiments, the adhesive coating may be heat sealable to itself. In some embodiments, the adhesive coating may be heat sealable to the paper wrap. In some embodiments, the adhesive coating may be heat sealable to both itself and the paper wrap. In some embodiments, there may be more than one type of adhesive coating applied to different portions of the outside surface of the paper wrap.

In embodiments where a heat-sealable adhesive is used, the type of heat-sealable adhesive may be chosen based on properties such as cost, bond strength, and/or heat-sealing conditions. Surprisingly, the inventors have found that adhesives typically used for bonding tissue to paper cores in paper products, or for bonding to plastic films, can also be used to form excellent seals in the paper wrapped product of the present invention. In some embodiments, the heat-sealable adhesive may be a non-wax, heat-sealable adhesive. In some embodiments, the heat-sealable adhesive may comprise a polyvinyl alcohol polyvinyl acetate, such as a polyvinyl alcohol stabilized vinyl acetate homopolymer or ethylene vinyl acetate. In some embodiments, the heat-sealable adhesive may comprise styrene butadiene rubber latex. In some embodiments, the heat-sealable adhesive may comprise polyvinyl acrylates. In some embodiments, the heat-sealable adhesive may be H.B. Fuller Pace® 383 adhesive. In some embodiments, the heat-sealable adhesive may be H.B. Fuller Swift® tak adhesive.

In some embodiments, the adhesive may be applied at a coating weight of from about 0.1 lbs/ream to about 5 lbs/ream, for example, from about 0.3 lbs/ream to about 3 lbs/ream, or from about 0.5 lbs/ream to about 2 lbs/ream. In some embodiments, for example, wherein the products are individually wrapped items, the adhesive may be applied at a coating weight of from about 0.2 lbs/ream to about 1 lbs/ream, or from about 0.25 lbs/ream to about 0.5 lbs/ream. In some embodiments, for example, wherein the products are bundled items, the adhesive may be applied at a coating weight of from about 0.25 lbs/ream to about 3 lbs/ream, for example from about 0.5 lb/ream to about 1.25 lbs/ream. Coat weight is determined by the dry coating weight in units of lbs/ream (3,000 square feet). As used herein, coat weight is determined relative to the area coated with the adhesive, not to the total area of the paper wrap. Thus, coat weight is the measure of the dry weight of the adhesive applied to an area of the paper wrap relative to only that area of the surface of the paper wrap where the adhesive is applied.

In some embodiments, due to the method of manufacture, the paper wrap may have one surface that is relatively smooth and one surface that is relatively rough, for example where the paper wrap is formed on a paper making machine employing a Yankee dryer. In such embodiments, the smooth side may be utilized as the outside surface. Without wishing to be bound by theory, it is believed that the application of adhesive may be improved when applied to the smooth side of the paper wrap, meaning that application of a given amount of adhesive on the relatively smooth side results in a higher seal strength than application of the same amount of adhesive on the relatively rough side. In some embodiments, applying the adhesive to both the outside and inside surfaces of the paper wrap may be preferred, as it increases the strength of both the belly and end seals.

In some embodiments, the outside surface of the paper wrap may have a Sheffield Roughness value of less than about 250 Sheff units, for example less than about 225 Sheff units, or between about 80 to about 250 Sheff Units. In some embodiments, the inside surface of the paper wrap may have a Sheffield Roughness value of more than about 300 Sheff units, for example more than about 340 Sheff units, or between about 300 to about 400 Sheff Units. Sheffield Roughness values may be measured according to Tappi T538.

In some embodiments, the portions of the paper wrap that are sealed with adhesive may have a max load seal strength of from about 8 to about 1200 $g_f$/inch width, for example from about 10 to about 400 $g_f$/inch width. This ensures that the seal strength is sufficient to seal the wrapper around the product during transport and storage, but not so strong as to impair the user from removing the wrapper or to cause fiber tear to the wrap or paper product when unwrapping. In some embodiments, the adhesive seals the wrap but does not cause fiber tear to the wrap or paper product when unwrapping. Without wishing to be bound by theory, it is believed that the portions of the paper wrap that are bonded by adhesive to adhesive bonds exhibit a higher max load seal strength than those bonded by adhesive to paper bonds.

In some embodiments, for example, wherein the products are individually wrapped items, the belly seal may have a max load seal strength of from about 8 to about 50 $g_f$/inch width, for example from about 10 to about 25 $g_f$/inch width, and the end seals may have a max load seal strength of from about 75 to about 150 $g_f$/inch width, for example from about 80 to about 120 $g_f$/inch width. In some embodiments, for example, wherein the products are individually wrapped items, both the belly seal and the end seals may have a max load seal strength of from about 75 to about 150 $g_f$/inch width, for example from about 80 to about 120 $g_f$/inch width. In some embodiments, for example, wherein the products are bundled items, the belly seal may have a max load seal strength of from about 8 to about 50 $g_f$/inch width, and the end seals may have a max load seal strength of from about 150 to about 800 $g_f$/inch width, for example from about 200 $g_f$/inch width to about 400 $g_f$/inch width. In some embodiments, for example, wherein the products are bundled items, both the belly seal and the end seals may have a max load seal strength of from about 150 to about 800 $g_f$/inch width, for example from about 200 $g_f$/inch width to about 400 $g_f$/inch width.

Max load seal strength was measured according to the following method. A paper wrapped product was obtained. The paper wrap was fully unwrapped and laid flat, and a location where the paper wrap was coated with an adhesive, but not sealed to another portion of the paper wrap or otherwise disturbed during the wrapping process, was identified to evaluate max load seal strength at that location (for example, at the end seals or belly seal). From that location, two identical sample strips were cut from the paper wrap of 1 inch width (Cross-Direction) by at least 2 inches long (Machine Direction), with at least the first 1 inch of the length of each sample strip being an area where the two strips were not adhesively sealed to one another when wrapped around the product. The strips were then placed together, and the first 1 inch of length was sealed by heat activation of the adhesive in a heat sealer machine at 300 F.° and 5 PSI for a dwell time of 0.5 seconds for paper with a basis weight of equal to or less than 20 lbs/3000 $ft^2$ or at 320 F.° and 5 PSI for a dwell time of 0.5 seconds for paper with a basis weight of more than 20 lbs/3000 $ft^2$. This resulted in the first 1 inch of the length of the sample strips being sealed together, with the remaining length of each sample strip being an unsealed "tail". The sealed sample strip was then placed in an Instron Tensile Tester, with the Instron set up with 20 lb. load cell and 1" grips on the top and bottom. The 1 inch sealed area of the test strip was held perpendicular to the Instron jaws, and the unsealed tail from each sample strip was clamped in each of the jaws at 90° angle from the sealed area. Peel speed for the Instron Tensile testers was set for 2"/min and peeled until the sealed area releases entirely. The results of the strength in $g_f$/inch width needed to completely separate the sealed strip was measured by the Tensile Tester and plotted in a graph from the point where there is no slack in the samples and the seal begins to release at one end to the point at which the end of the sealed area releases. The max load seal strength is the strength in $g_f$/inch width at the peak (or highest plateau) of the plotted graph. The average seal strength may also be determined as the average strength in $g_f$/inch width over the entire plotted graph. Any visible fiber tear in the seal area should also be noted.

In some embodiments, the at least one adhesive coated on the portions of the paper wrap covering the top and bottom surfaces of the product (forming the end seals) may be the same as the adhesive coated on the portions of the paper wrap covering the at least one side surface of the product (forming the belly seal). In some embodiments, the at least one adhesive coated on the portions of the paper wrap covering the top and bottom surfaces of the product (forming the end seals) may be different from the adhesive coated on the portions of the paper wrap covering the at least one side surface of the product (forming the belly seal). This may be seen in FIGS. 4, 6, 8, and 10, which show different shading for the horizontal solid shaded areas that comprise the first, second, third, and fourth portions of the outside surface of the paper wrap and the vertical solid shaded areas comprising the fifth and/or sixth portions of the outside surface of the paper wrap.

In some embodiments, for example in the case of a roll or bundle product, it may be desirable for the adhesive coated on the portions of the paper wrap covering the top and bottom surfaces of the product (forming the end seals) to be chosen to form a stronger bond than the adhesive coated on the portions of the paper wrap covering the side surface (forming the belly seal). In some embodiments, for example wherein the products are individually wrapped items, the max load seal strength on the ends of the roll product (e.g. between the first and second portions of the outside surface of the paper wrap and between the third and fourth portions of the outside surface of the paper wrap) may be from about 35 $g_f$/inch width to about 125 $g_f$/inch width (for example, from about 50 $g_f$/inch width to about 100 $g_f$/inch width) and the max load seal strength on the side seal of the product (e.g., between the fifth portion of the outside surface of the paper wrap and the first portion of the inside surface of the paper wrap) may be from about 10 $g_f$/inch width to about 50 $g_f$/inch width (for example, from about 15 $g_f$/inch width to about 45 $g_f$/inch width). In some embodiments, for example wherein the products are bundled items, the max load seal strength on the ends of the bundled product (e.g. between the first and second portions of the outside surface of the paper wrap and between the third and fourth portions of the outside surface of the paper wrap) may be from about 225 $g_f$/inch width to about 375 $g_f$/inch width (for example, from about 250 $g_f$/inch width to about 350 $g_f$/inch width) and the max load seal strength on the side seal of the product (e.g., between the fifth portion of the outside surface of the paper wrap and the first portion of the inside surface of the paper wrap) may be from about 200 $g_f$/inch width to about 250 $g_f$/inch width (for example, from about 210 $g_f$/inch width to about 240 $g_f$/inch width). Conversely, in some embodiments, it may be desirable for the adhesive bond on the top and bottom surfaces (the "ends") to be weaker than on the side surface ("the belly").

In some embodiments, the adhesive used on the portions of the paper wrap covering the top and bottom surfaces of the product (forming the end seals) may be chosen such that it is better at bonding to itself than to the paper wrap and the adhesive used on the portion of the paper wrap covering the side surface of the product (forming the belly seal) may be chosen such that it is better at bonding to the paper wrap than to itself.

In some embodiments, adhesive is applied to portions totaling at least 25% of the total outside surface of the paper wrap, for example, at least about 35%, at least about 50%, at least about 75%, or substantially 100%. In some embodiments, the at least one adhesive is applied to portions comprising between about 20% to about 80% of the total outside surface of the paper wrap, for example, from about 25% to about 75%, or from about 35% to about 65%. In some embodiments, adhesive may also be applied to portions totaling at least 25% of the total inside surface of the paper wrap, for example, at least about 35%, at least about 50%, at least about 75%, or substantially 100%.

In some embodiments, the at least one adhesive may be applied to portions of the outside surface of the paper wrap as uniform or arranged in one or more patterns. The patterns may comprise discrete shapes or designs, such as repeating stripes, dots, squares, triangles, or any other design such that the adhesive coverage in that coated portion is less than uniform ("uniform" coverage meaning that the pattern covers 100% of the surface area of the coated portion). In some embodiments, the pattern may provide less than about 90% coverage of the surface area of the coated portion, such as less than about 75% coverage, less than about 50% coverage, less than about 25% coverage, or less than about 7% coverage. In some embodiments, the pattern may provide between about 25% coverage and about 75% coverage, such as from about 40% coverage to about 60% coverage. In some embodiments, the at least one adhesive may be applied to one or more portions of the paper wrap in a first pattern and one or more portions of the paper wrap in a second pattern. In some embodiments, the at least one adhesive may be applied to the first, second, third, and/or fourth portions of the outside surface of the paper wrap in a first non-uniform pattern (such as from about 40% coverage to about 60% coverage) and at least one adhesive may be applied to the fifth and/or sixth portions of the outside surface of the paper wrap in a uniform 100% coverage pattern. FIGS. 11-14 show exemplary embodiments wherein a paper wrap according to the present invention was coated with adhesive applied in a vertical line in a 100% coverage pattern corresponding to the area that forms the belly seal and in two horizontal lines corresponding to the areas that form the end seals in coverage patterns of 100%, 50%, 25%, and 7%.

Having adhesive bonded to the product itself may negatively affect the product and is therefore preferably avoided. In some embodiments, adhesive is coated on the outside surface of the paper wrap such that, when wrapped around the product, less than at least about 10% of the at least one adhesive applied to the outside surface of the paper wrap, for example, less than about 5%, or less than about 1% contacts the product. In this way, any bond formed between the adhesive and the product itself, as well as any resulting damage or tearing to the product, may be minimized when the wrapper is removed from the product.

Similarly, exposed adhesive on the outside of the product after wrapping may lead to excess blocking when the paper wrapped products are stacked one on top of another and exposed to ambient heat and stack load pressure during, for example, transportation or storage of the products. By minimizing the amount of adhesive that remains exposed on the outside of the wrapped product after wrapping, blocking caused by any bonding of exposed adhesive on the outside of one product to exposed adhesive on the outside of another product may be minimized when the products are stacked or bundled together. In some embodiments, adhesive is coated on the outside surface of the paper wrap such that less than about 50% of the adhesive coating remains exposed on the outside of the product after wrapping. In some embodiments, adhesive is coated on the outside surface of the paper wrap such that less than about 35% of the adhesive coating remains exposed on the outside of the product after wrapping, for example less than about 20%, less than about 10%, or less than about 5%.

Figure 5:
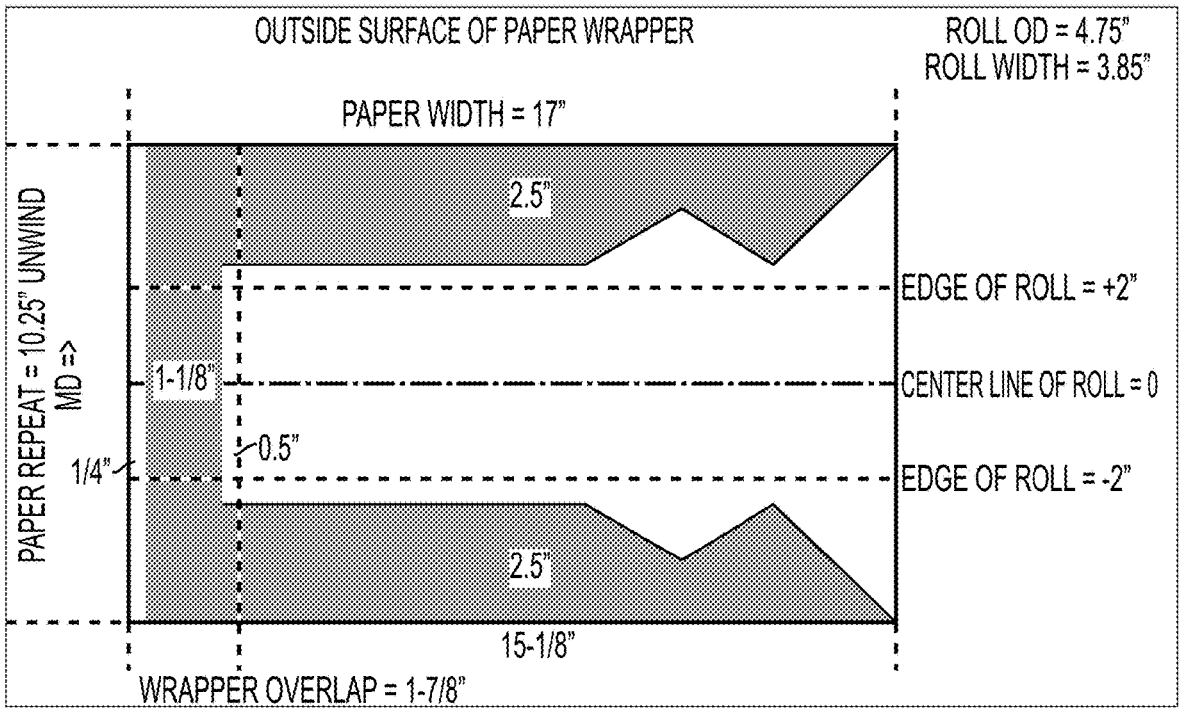
FIG. 5 depicts an exemplary adhesive configuration on the outside surface of a paper wrap for an individually wrapped item according to the present invention using a single adhesive and having a non-uniform geometry in the application of the adhesive shown by triangular cutouts in the horizontal areas corresponding to the end seals in order to minimize the amount of adhesive that remains exposed on the surface of the product after wrapping.
Figure 6:
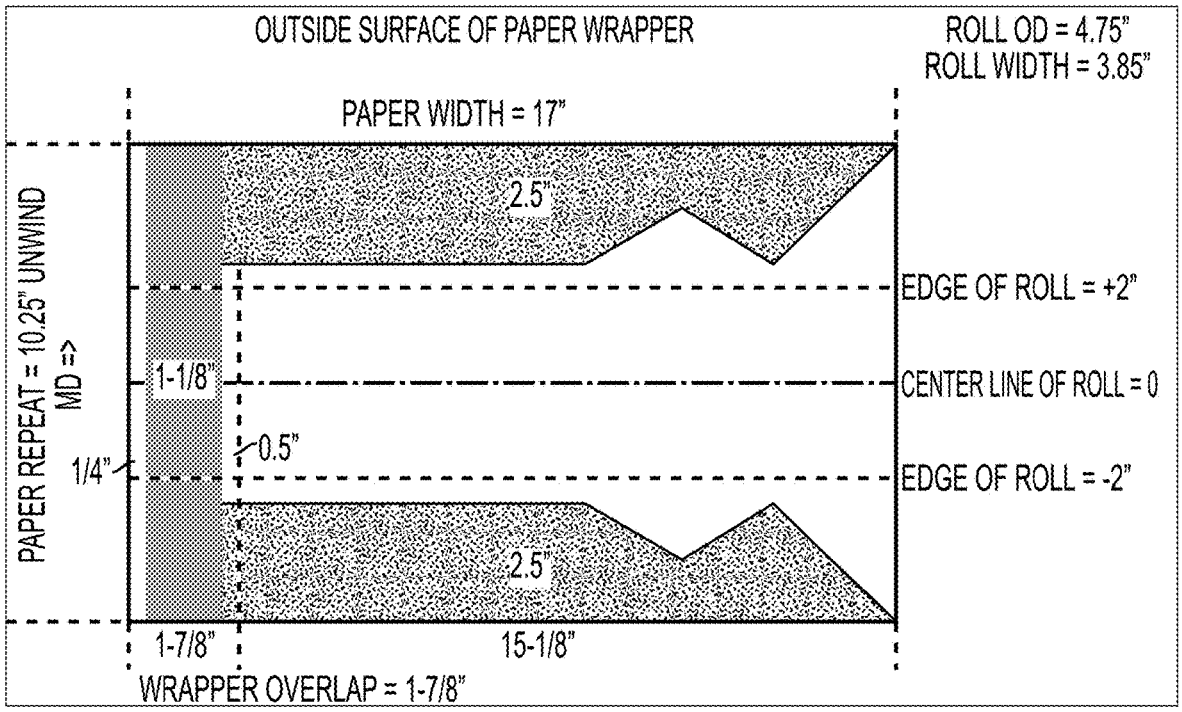
FIG. 6 depicts an exemplary adhesive configuration on the outside surface of a paper wrap for an individually wrapped item according to the present invention using two different adhesives shown by the different shading (one adhesive for the belly seal and one adhesive for the end seals) and having a non-uniform geometry in the application of the adhesive shown by triangular cutouts in the horizontal areas corresponding to the end seals in order to minimize the amount of adhesive that remains exposed on the surface of the product after wrapping.
Figure 7:
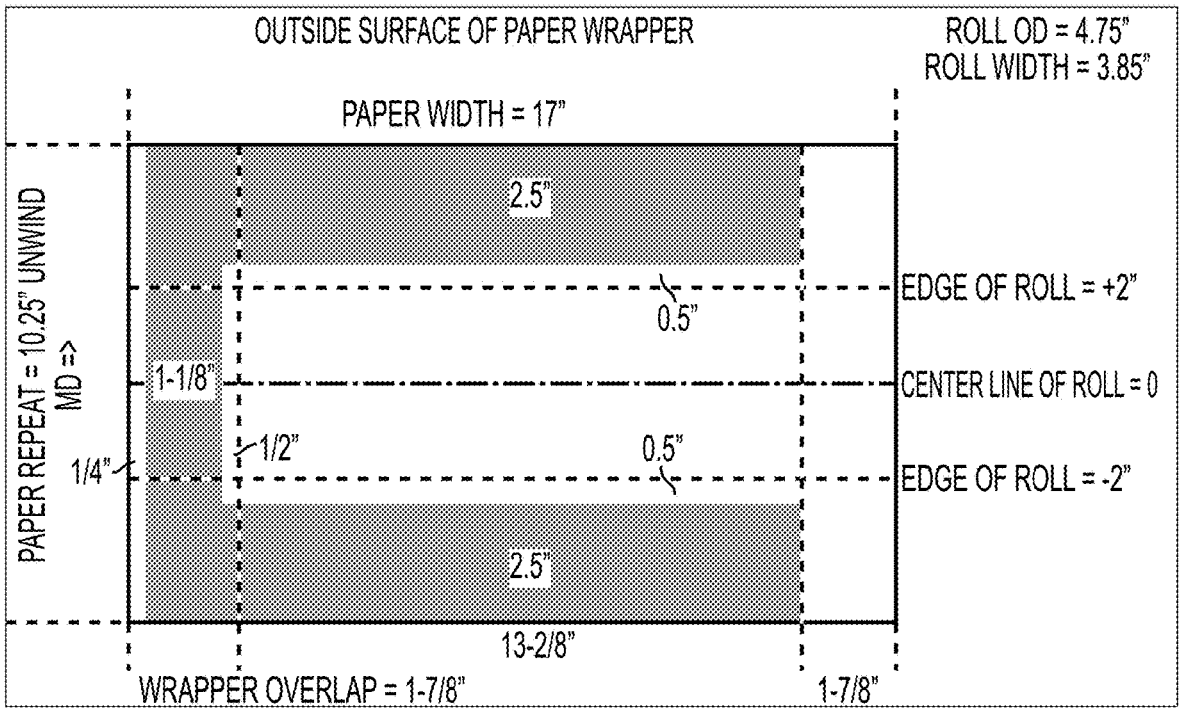
FIG. 7 depicts an exemplary adhesive configuration on the outside surface of a paper wrap for an individually wrapped item according to the present invention using a single adhesive and wherein the adhesive is not applied to the far right edge of the horizontal areas corresponding to the end seals in order to minimize the amount of adhesive that remains exposed on the surface of the product after wrapping.
Figure 8:
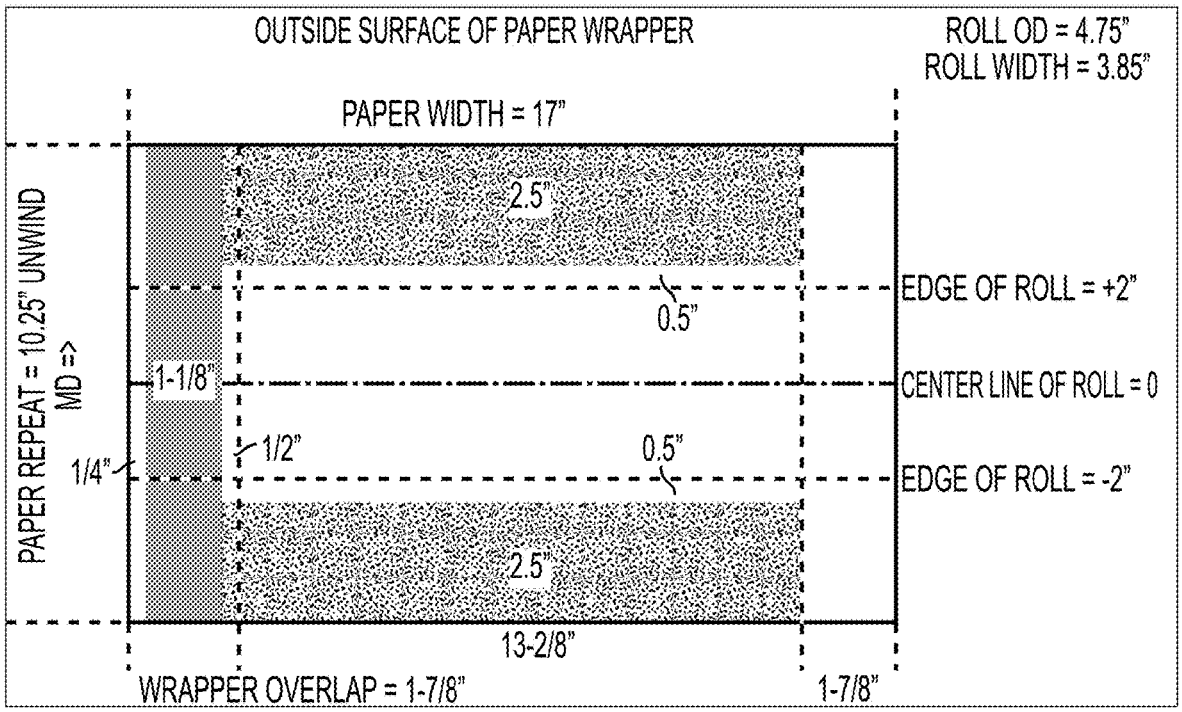
FIG. 8 depicts an exemplary adhesive configuration on the outside surface of a paper wrap for an individually wrapped item according to the present invention using two different adhesives shown by the different shading (one adhesive for the belly seal and one adhesive for the end seals) and wherein adhesive is not applied to the far right edge of the horizontal areas corresponding to the end seals in order to minimize the amount of adhesive that remains exposed on the surface of the product after wrapping.

FIGS. 5 and 6 disclose exemplary embodiments of one way in which the amount of adhesive remaining exposed on the outside of the paper wrap after wrapping may be minimized, for example, by applying the adhesive in a non-uniform geometry where adhesive is strategically applied in the areas where the outside surface of the paper wrap is most likely to overlay itself after wrapping (shown in FIGS. 5 and 6 in the shaded areas) and where adhesive is not applied in areas of the outside surface of the paper wrap that are most likely to remain exposed after wrapping (shown in FIGS. 5 and 6 as triangular cutouts in the horizontal shaded areas). As shown in FIGS. 2A-2D, the areas where adhesive may be avoided may be identified by wrapping the product, marking those areas left exposed on the outside of the product and those areas where the paper wrap overlaps itself, and then unwrapping the wrap to show the full geometry of where adhesive should be applied. FIG. 7 similarly depicts an exemplary configuration wherein adhesive is not applied to the far right edge of the outside surface of the paper wrap, an area likely to remain exposed after wrapping. These exemplary embodiments thus demonstrate ways in which the amount of adhesive remaining exposed on the outside of the paper wrap after wrapping may be minimized and therefore excess blocking when the paper wrapped products are stacked one on top of another may be avoided.

In some embodiments, the outside surface of the paper wrap may additionally be "printed" to include markings, for example decorative elements, patterns, or informational markings, such as text or eye marks. In some embodiments, the markings may be made by printing inks.

The present application further discloses methods for making improved paper wrapped products according to the disclosed embodiments which comprise: covering a product in a paper wrap; the product having a top surface, a bottom surface, and at least one side surface; the paper wrap having an inside surface and an outside surface; said covering comprising folding back a first portion of the outside surface of the paper wrap to overlay a second portion of the outside surface of the paper wrap at a position covering the top surface of the product, folding back a third portion of the outside surface of the paper wrap to overlay a fourth portion of the outside surface of the paper wrap at a position covering the bottom surface of the product, and overlaying a first portion of the inside surface of the paper wrap over a fifth portion of the outside surface of the paper wrap at a position covering at least one side surface of the product; coating at least one of the first and second portions of the outside surface of the paper wrap with at least one first adhesive, coating at least one of the third and fourth portions of the outside surface of the paper wrap with at least one second adhesive, and coating the fifth portion of the outside surface of the paper wrap with at least one third adhesive; and bonding with the at least one adhesive each of (i) the first portion of the outside surface of the paper wrap to the second portion of the outside surface of the paper wrap, (ii) the third portion of the outside surface of the paper wrap to the fourth portion of the outside surface of the paper wrap, and (iii) the fifth portion of the outside surface of the paper wrap to the first portion of the inside surface of the paper wrap.

In some embodiments, the method further comprises "printing" the outside surface of the paper wrap to include markings, for example decorative elements, patterns, or informational markings, such as text or eye marks. In some embodiments, the markings may be made by printing inks. In some embodiments, the markings (for example those made by printing inks) may be applied to the outside surface of the paper wrap first, and the adhesive may be applied to the outside surface of the paper wrap second, such that the adhesive is applied on top of the markings where the adhesive coverage overlaps the coverage of markings. In some embodiments, the markings (for example those made by printing inks) and the adhesive may be simultaneously applied to the outside surface of the paper wrap. In some embodiments, the markings (for example those made by printing inks) may be applied to areas of the outside surface of the paper wrap that overlap with or are the same as the areas of the outside surface of the paper wrap where adhesive is applied. In some embodiments, the markings (for example those made by printing inks) may be applied to areas of the outside surface of the paper wrap that are separate from the areas of the outside surface of the paper wrap where adhesive is applied.

In some embodiments, the adhesive may be applied using various coating methods such as rod coating, direct gravure coating, indirect gravure coating, blade coating, air knife coating, or flexographic print coating. In some embodiments, using flexographic print coating may be preferred, since the adhesive can be applied to the outside of the paper wrap during the same manufacturing step as printing or marking the paper wrap. Flexographic printing presses can apply multiple bumps of coating in a single pass in order to achieve higher coating weights and can register areas to be coated corresponding to the seal area portions as well as 100% coverage over the entire wrap.

The paper may be wrapped around the product by hand or using a wrapping machine, for example a heat seal wrap machine. In some embodiments, the at least one adhesive may be heat-sealed at a temperature of between about 200° F. to about 700° F., for example, from about 300° F. to about 650° F., from about 450° F. to about 600° F., or from about 450° F. to about 500° F. In some embodiments, the at least one adhesive may be heat-sealed at a pressure of from about 0.5 to about 5 psi, for example, from about 0.5 to about 3 psi, or from about 0.5 to about 2 psi, or from about 0.5 to about 1 psi. In some embodiments, the pressure on the ends may be from about 0.5 to about 2 psi, while the pressure on the side (or "belly") may be from about 0.5 to about 1 psi.

Descriptions of the disclosed embodiments are not exhaustive and are not limited to the precise forms or exemplary embodiments disclosed. Modifications and adaptations of the exemplary embodiments will be apparent from consideration of the specification and practice of the disclosed embodiments.

EXAMPLES

Example 1

Paper wraps coated with adhesive in differing coverage patterns were wrapped around individual coreless tissue roll products on a heat seal wrap machine and then examined. The roll width was 3.85" and the roll outside diameter was 4.75". The paper wrap used was 15 lbs/3000 $ft^2$ (15 #) printed bleached (BL) machine glazed (MG) paper (15 #BL MG). The adhesive used was H.B. Fuller Pace® 383 adhesive. The coverage patterns varied from 100% coverage patterns to 7% coverage patterns, as shown in FIGS. 11-14.

The paper wraps were folded around each bath tissue roll such that a first portion of the outside surface of the paper wrap was folded back to overlay a second portion of the outside surface of the paper wrap at a position covering the top surface of the product; a third portion of the outside surface of the paper wrap was folded back to overlay a fourth portion of the outside surface of the paper wrap at a position covering the bottom surface of the product; and a first portion of the inside surface of the paper wrap overlaid a fifth portion of the outside surface of the paper wrap at a position covering the side surface of the roll product. The adhesive was applied to each of the first, second, third, fourth, and fifth portions of the paper wrap. The adhesive coating was applied to the smooth side of the paper wrap (the outside surface) at 0.5 to 0.7 lbs/3000 $ft^2$ dry coat weight. The Sheffield Roughness value of the outside surface of the paper wrap was 230 Sheff units.

Each of the patterns was ranked based on seal performance. To be considered successful, the paper wrapper must have been securely sealed flat on each end and the belly seal must have been able to hold the overlap in place to protect the product. When opening the paper wrapper, the end seals should peel apart without fiber tear to the wrap. The wrap should come off in one piece with minimal effort or frustration. The goal of this trial was to determine if applying the adhesive in different coverage patterns could improve the overall performance of the wrap.

The initial conditions were as follows: (1) belly seals and two end seals were required; (2) the end seal temperature was set at 350° F.; (3) the end seal pressure was set to 2-3 psi; (4) the belly seal temperature was set at 450° F.; and (5) the steady state temperature was set, confirming that the seal temperature was holding steady at +/−5° F. before running.

For each variable trial, with the seal temperatures at steady state, about 10 rolls were run at a speed of 100 rolls/min or higher and shut down. The heat seals were then peeled apart by hand to determine how well the product was sealed. If the seals were approved, 100 rolls were run. The wrapped rolls were then stacked in suitable corrugate boxes (5 ft×4 ft×4 ft), labeled, and placed on pallets. The trial was then re-run with the next variable wrapper and the results checked for each. The change in seal appearance and amount of force needed to unwrap the seals for each variable trial was noted. If the seals were too weak, the temperature and/or pressure was increased as needed, with a max temperature of 600° F.

The method of analysis involved: (1) unwrapping the rolls by hand starting with the belly strip and then to the end seals; (2) the wrapper was expected to be removed in a single piece with minor to no tearing; (3) the seal should be strong enough to hold the wrapper in place with no excess wrapping sticking out, with flat end seals; and (4) the belly seal should prevent open contact with the product but take less force than the end seals to open.

The desired seal strength success criteria were defined as follows. For the ends (top and bottom) seals: less than 25% fiber tear, surface fiber tear only, and no fiber tearing through the sheet or shredding of the wrapper to open. For the belly (side) seals: 0% fiber tear and weak seal strength with enough bond to hold the overlap tail down without visually exposing the product. The wrap must open easily with minimal exertion; the wrapped roll seal must be sealed well enough that the ends are pressed together tightly and acquire a clean appearance; the wrapped roll's seal must be able to endure a single 3 ft belly or edge drop test; and the adhesive coating must release cleanly and, from a visual inspection, not significantly build up on the Teflon® seal belts of the wrapper machine. The results of the seal strength test are shown in Table 1 below.

TABLE 1

| ID | Adhesive Coverage | Heat Seal Temp (F) | Tack Bond Level |
|---|---|---|---|
| 1 | 100% Coverage Lanes | 600° F. | High |
| 2 | 50% Coverage Stripes | 600° F. | Medium |
| 3 | 25% Coverage Squares | 600° F. | Low |
| 4 | 7% Coverage Dots | 600° F. | Very Low |

Key

| Tack Bond Level* | Failed/Passed |
|---|---|
| Fiber Tear | Fail: Seal too strong |
| High | Pass: Acceptable |
| Medium | Pass: Target |
| Low | Pass: Acceptable |
| Very Low | Fail: No seal strength |

*Tack Bond Level was based on feel when opening the wrap and removing it from roll.

Samples of paper wrapped coreless bath tissue rolls were also prepared according to Table 2 below and placed in an environmental chamber for 48 hours to test the potential for blocking while being transported in a variety of different environments, including varying temperatures, from 110° F. to 130° F. and 50% Relative Humidity. The wrapped rolls were placed on top of each other with a 25-pound weight evenly displaced between them. The objective of this test was to identify if blocking is a problem with the adhesives at this temperature range (the estimated temperature range the final wrapped product may encounter during shipment). The results of the blocking test are shown in Table 2 below.

TABLE 2

Blocking Test Results:

| % Adhesive Coverage Pattern | Seal Temperature, ° F. | Chamber Temperature, ° F. | Blocking Potential (Visual Rating) |
|---|---|---|---|
| 100% | 600° F. | 110° F. | Low |
| 100% | 600° F. | 120° F. | Low |
| 100% | 600° F. | 130° F. | Low |
| 100% | 450° F. | 110° F. | Low |
| 100% | 450° F. | 120° F. | Low |
| 100% | 450° F. | 130° F. | Low |
| 50% | 550° F. | 110° F. | Slight |
| 50% | 550° F. | 120° F. | Slight |
| 50% | 550° F. | 130° F. | Slight |
| 50% | 600° F. | 120° F. | Slight |
| 50% | 600° F. | 130° F. | Slight |
| 25% | 600° F. | 120° F. | None |
| 25% | 600° F. | 130° F. | None |

Based on the Results shown in Table 1, the 7% adhesive coverage pattern was found to be less desirable due to the lack of seal strength and the looseness of the wrapper. The 25% adhesive coverage pattern was found to be better, but still less desirable for end seal strength. The 50% adhesive coverage pattern was found to be preferred and the 100% coverage pattern was at the high end of the acceptable range. Based on blocking tests, the 25% or 50% coverage patterns were deemed preferable.

In general, the higher the adhesive coverage, the higher the bond that was noticed when opening the end of the wrap.

It was noted by those opening the rolls that it appeared that the 50% adhesive coverage pattern samples seemed preferable for the tack bond level and met the following criteria: (a) less than 25% fiber tear; (b) the wrap opened easily with minimal frustration or effort; (c) the wrapped roll was sealed well enough to make a clean, neat package; and (d) the adhesive coating released cleanly and did not build up on the Teflon® seal belts.

The inventors learned that, surprisingly, the strongest seals were made when the adhesive was applied to each of the first, second, third, and fourth portions of the outside surface of the paper wrap corresponding to the area under flaps 1 and/or 2 labeled in FIGS. 2A-2C. At these locations, the heat can penetrate the paper with less resistance to create adhesive-to-adhesive bonds.

Based on the results in Table 2, the higher adhesive coverage patterns were found to have a higher potential to result in blocking between layers of rolls when stacked together or packaged together as a bundle inside poly bags. However, the blocking testing confirmed that even at the 100% adhesive coverage pattern, while keeping the storage temperature below 130° F., there was only a limited amount of blocking between layers of products.

Example 2

A second trial was held to evaluate possible sheet count and adhesive coverage combinations. Sheet count refers to the number of sheets in the roll product tested, where the diameter of the roll product was held constant for all samples. In general, increasing the number of sheets in a roll product of constant diameter leads to an increase in density and hardness of the roll. In general, the harder the roll, the higher the effective heat seal pressure. Table 3 outlines the combinations tested in the trial. The same 15 #BL MG paper and adhesive coating process as discussed in Example 1 was used to produce the wrap.

TABLE 3

| Sheet Count | % Adhesive Coverage Pattern | Seal Temp. |
|---|---|---|
| 505 | 50% | 600° F. |
| 505 | 25% | 600° F. |
| 555 | 50% | 600° F. |
| 555 | 25% | 600° F. |
| 605 | 50% | 600° F. |
| 605 | 25% | 600° F. |
| 705 | 50% | 600° F. |
| 705 | 25% | 600° F. |

The samples were evaluated for qualitative seal strength and blocking. The qualitative seal strength evaluation was a visual test assessing the quality of the seal strength. For the qualitative seal strength evaluation, rolls were removed from each case and, upon removal, the wraps on the rolls were removed by hand by inserting a hand in through the belly seal and lifting the roll. The rolls were then ranked on a scale of 1 to 5, according to the criteria outlined in the key for Table 4 below. A 1 or 5 rating results in a failure, while a 2 to 4 rating results in a pass. The results of the qualitative seal strength evaluation are shown in Table 4 below:

TABLE 4

Seal Strength Evaluation - Results

| Sample # | Sheet Count | Percent Coverage | Average Rating | Seal Strength Pass/Fail |
|---|---|---|---|---|
| 1-15 | 505 | 25% | 2.1 | 15 Pass |
| 16-31 | 605 | 25% | 2.1 | 14 Pass/1 Fail |
| 32-48 | 505 | 50% | 2.4 | 15 Pass |
| 49-64 | 705 | 25% | 2.6 | 15 Pass |
| 65-81 | 705 | 50% | 2.8 | 15 Pass |
| 82-98 | 555 | 50% | 3.1 | 15 Pass |
| 99-115 | 555 | 25% | 1.9 | 12 Pass/3 Fail |
| 116-131 | 605 | 50% | 3.3 | 14 Pass/1 Fail |

Key

| Fail 1 Very poor | Pass 2 Weak | Pass 3 Okay | Pass 4 Strong | Fail 5 Very strong |
|---|---|---|---|---|
| Seal immediately comes undone once touched | Seal comes undone when lifted | Seal does not come undone when lifted, but cannot handle shaking | Supports the hold test and needs to be shaken to come undone | Have to be shaken violently and/or have a fiber tear to come undone |

The qualitative seal strength evaluation indicated that adhesive in a 50% coverage pattern leads to an overall stronger seal. Other results demonstrated that: (a) the 505 sheet count roll was soft, resulting in weak seal strength and (b) the 555 sheet count with adhesive in a 50% coverage pattern combination had optimal seal strength as all rolls had a passing rating of either 3 or 4 (with the exception of two roll samples with a rating of 2). The 555 and 605 sheet count with adhesive in a 50% coverage pattern combinations had an average rating of a '3' or more, meeting the defined target.

The blocking test was again used to evaluate how the adhesive coverage affects sticking and fiber tear of the wrap when rolls are stacked together, replicating that of storage and transportation conditions. For the blocking test, two rolls were stacked on top of each other and placed in parallel with another stack. A 25-pound weight was equally distributed across the top of the rolls. The rolls were then placed in a conditioned environmental chamber for 48 hours, and the chamber was adjusted to stay at a temperature of 120° F. and a relative humidity of 80%. After 48 hours, the rolls were removed in their current condition. The tester then slowly removed the top roll from the bottom roll and evaluated the sticking and/or fiber tear of the wrap. Any resulting fiber tear to the rolls or overwrap was considered a 'fail.'

The blocking test demonstrated that use of adhesive in a 50% coverage pattern resulted in slightly more blocking than use of adhesive in a 25% coverage pattern. However, utilization of the 50% coverage pattern did not result in an unacceptable level of blocking. There was no resulting fiber tear from either the 25% or 50% coverage patterns.

Figure 15:
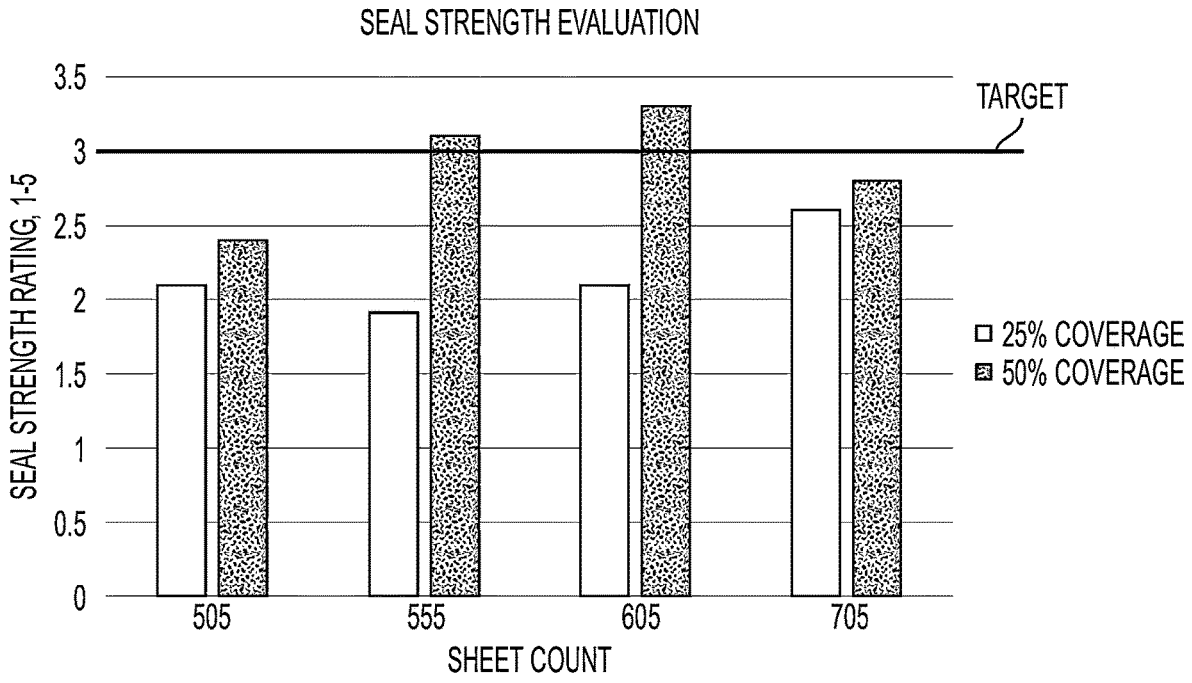
FIG. 15 depicts a graphical representation of the Seal Performance from Example 2.

Based on the results of both tests, a preferred sheet count and adhesive coverage combination would include 555 sheets with adhesive in a 50% coverage pattern. None of the 25% adhesive coverage pattern variations fell within the target. Neither the 25% nor 50% adhesive coverage pattern 505 sheet count variations fell within the target. 705 sheet count with 50% adhesive coverage pattern also fell short of the target. A graphic depiction of these results is shown in FIG. 15.

While higher adhesive coverage patterns do result in more blocking, this can be reduced by strategically omitting the adhesive from portions that remain on the outside surface of the paper wrap after wrapping as shown in FIGS. 5-8. Post-trial testing revealed that blocking was occurring primarily on the top and bottom flaps of the roll, though there was no resulting fiber tear.

Example 3

A third trial was held to understand the feasibility and performance of a paper overwrap design for a bath tissue bundle to replace typically used poly film paper wraps. The design of the paper overwrap for the bath tissue bundle tested in this trial utilized the same technology discussed above in Example 1, wherein a heat sealable adhesive coating was applied to the wrapper and heat sealed to itself at the end of each roll where the excess wrapper was folded back to overlay other portions of the outside surface of the paper wrap. However, in this trial the paper wrap was applied to a bundle of bath tissue rolls instead of individual rolls.

The initial feasibility trial was done wherein the paper wrap utilized 100% coverage of the heat sealable adhesive coating with a dry coat weight of 1.5 #/ream. The paper wraps used were 25 lbs/3000 $ft^2$ (25 #) and 30 lbs/3000 $ft^2$ (30 #) MG paper. The adhesive used was H.B. Fuller Pace® 383 adhesive. The Sheffield Roughness value of the outside surface was 200 to 250 Sheff units, while the Sheffield Roughness value of the inside surface was 300 to 350 Sheff units. Similar to the wrap utilized in the trial discussed in Example 1 with the individual coreless bath tissue roll, the wrap in this trial consisted of two end seals and a side (belly) seal, as shown in FIGS. 16 and 17. Seven different design variations were assessed, as described in Table 5 below. As used herein, "C1S" is defined as having adhesive coating on only either the outside or the inside surface of the paper wrap. As used herein, "C25" is defined as having adhesive coating on both the outside and the inside surfaces of the paper wrap.

TABLE 5

| Basis Weight lbs/ream | C1S or C2S? | Temperature (degrees F) | Coated side in or coated side out? | Belly seal? |
|---|---|---|---|---|
| 25 | C1S | 500 | Inside | No |
| 25 | C1S | 500 | Outside | No |
| 25 | C1S | 600 | Outside | No |
| 30 | C1S | 600 | Inside | No |
| 30 | C1S | 600 | Outside | No |
| 25 | C2S | 600 | Both | Yes |
| 30 | C2S | 600 | Both | Yes |

Initial trial testing included heat seal strength testing, which measured three variables at increasing temperatures (170-400° F.): (1) average peel force, maximum load, and estimated percentage of fiber tear. The seal time was 0.5 seconds, the pressure was 5 psi, and the lower jaw was left at room temperature. Both the 25 lbs/3000 $ft^2$ (25 #) and 30 lbs/3000 $ft^2$ (30 #) paper were tested.

Results of the heat seal strength testing indicated generally that as temperature was increased, average peel force and fiber tear percentage increased. In order to achieve a balance between opening the package without frustration and having enough seal strength to prevent tampering, a percent fiber tear of at least 40% or higher may be desired. The results demonstrated that, in order to achieve a fiber tear percentage of 40% or higher, a temperature of 200° F. or higher may be desired. The results also demonstrated that, even at a fiber tear percentage of 100%, maximum load is only between 200-400 $g_f$/inch width. This may be due to the wrap containing 100% recycled fiber content. If the wrap contained a higher amount of virgin fiber, maximum load values may exceed 1,000 $g_f$/inch width or higher.

Initial trial testing also included seal strength rating, wherein a rating scale of both the end seals and the belly seal was created, which can be seen in Table 6 below. The seals were rated on a scale from a 1 to 5, with a 1 being a very poor seal and a 5 being a very strong seal. Any rating from 2 to 4 is a pass, while any rating that is a 1 or 5 is a fail. The target rating is a 3.

TABLE 6

| Rating Scale | | | | |
|---|---|---|---|---|
| 1 | 2 | 3 | 4 | 5 |
| Fail<br>Very poor<br>*Seal immediately comes undone once touched and requires no tearing | Pass<br>Weak<br>*Seal comes undone with minimal tearing with no resulting fiber tear | Pass<br>Okay<br>*Seal comes undone with tearing with a fiber tear | Pass<br>Strong<br>*Seal comes undone with tearing and requires a rigorous fiber tear in order to be opened | Fail<br>Very strong<br>*Product is difficult/frustrating to open and has to be torn aggressively to be opened |

Samples of each variable were opened, and the seal strength of both the end seals and belly seal were rated from 1 to 5. Results are shown in Table 7.

TABLE 7

| Basis Weight lbs/ream | C1S or C2S? | Temperature (degrees F.) | Inside or Outside Coated? | Belly Seal? | End Seal Quality | Belly Seal Quality |
|---|---|---|---|---|---|---|
| 25 | C1S | 500° F. | Inside | No | 3 | 1 |
| 25 | C1S | 500° F. | Outside | No | 2 | 1 |
| 25 | C1S | 600° F. | Outside | No | 3 | 1 |
| 30 | C1S | 600° F. | Inside | No | 4 | 1 |
| 30 | C1S | 600° F. | Outside | No | 2 | 1 |
| 25 | C2S | 600° F. | Both | Yes | 4 | 2 |
| 30 | C2S | 600° F. | Both | Yes | 4 | 2 |

Initial trial testing also included product sticking rating, wherein the same test used in the seal strength test was used for the product sticking test—i.e., how much, if at all, the wrapper was sticking to the product and how much, if any, damage was caused to the product. Using the rating system shown in Table 8 below, once the product was removed from the package, it was rated on sticking from a 1 to 5. A 1 rating indicated no sticking to the product, while a 5 indicated a large amount of damage to the product. The target rating is a 1 or 2.

TABLE 8

| Rating Scale | | | | |
|---|---|---|---|---|
| 1 Pass | 2 Pass | 3 Pass - Warning | 4 Fail | 5 Fail |
| No Sticking | Minimal Sticking | Small Amount of Product Damage | Medium Amount of Product Damage | Large Amount of Product Damage |
| *Overwrap does not stick to the product at all | *Overwrap sticks to the product, but is easy to remove and the product is not damaged | *Overwrap sticks to the product but is easy to remove. However, removing the wrap results in a small amount of product damage | *Overwrap sticks to the product and is difficult to remove and results in a medium amount of product damage | *Overwrap sticks to the product and is very difficult to remove and results in a large amount of product damage |

Once opened, all product was removed from the package and examined for any sticking and/or product damage, as shown in Table 9.

TABLE 9

| Basis Weight lbs/ream | C1S or C2S? | Temperature (degrees F) | Inside or Outside Coated? | Belly Seal? | Product Sticking |
|---|---|---|---|---|---|
| 25 | C1S | 500 | Inside | No | 1 |
| 25 | C1S | 500 | Outside | No | 1 |
| 25 | C1S | 600 | Outside | No | 1 |
| 30 | C1S | 600 | Inside | No | 2 |
| 30 | C1S | 600 | Outside | No | 1 |
| 25 | C2S | 600 | Both | Yes | 2 |
| 30 | C2S | 600 | Both | Yes | 2 |

Results demonstrated that use of adhesive on both the outside and inside surfaces of the paper wrap resulted in a stronger belly seal and stronger end seals. And while there was slight product sticking, there did not appear to be product damage in ambient conditions. Additional testing was conducted to understand the performance of the initial designs, as discussed in Examples 4 and 5 below.

Example 4

A runnability trial was conducted to apply machine modifications to optimize the paper wrap with goals of increasing the belly seal strength and reducing wrinkles in the wrap. For example, new seal bar and contrast bars were installed and spacing adjusted. The pressure was further decreased to decrease wrinkles in the paper. The trial was successful in meeting these goals.

The 25 # bleached C2S paper wrap with 1.0 # of coating ran well, as there were minimal runnability issues and no hard wrinkles. The 1.0 # coating was sufficient in providing a much stronger belly seal than what was seen in earlier feasibility trials.

Heat seal strength testing was again conducted. For the heat seal strength testing, the peel force and percent fiber tear was measured on outside-to-outside coating contact, inside-to-outside coating contact, and inside-to-inside coating contact.

Results of the heat seal strength testing indicated that in order to achieve a balance between opening the package without frustration and having enough seal strength to prevent tampering, a max load seal strength sufficient to obtain a percent fiber tear of at least 40% or higher upon unwrapping may be preferred. The results demonstrated that, in order to achieve a fiber tear percentage of 40% or higher, a temperature range of 200-300° F. or higher may be preferred when sealing the adhesive. The results also demonstrated that, at a fiber tear percentage of 100%, the maximum max load seal strength may preferably be between 150-300 g/inch width for the 1.0 # coating and between 200-400 g/inch width for the 1.5 # coating. Therefore, as coating weight is increased, the amount of force it takes to open the paper wrap will be higher (i.e. more seal strength).

Seal strength testing was also conducted in this trial. Samples of each variable were opened, and the seal strength of both the end seals and belly seal were rated from 1 to 5. Results are shown in Table 10.

TABLE 10

| Basis Weight lbs/ream | C1S or C2S? | Coating Weight lbs/ream | Inside or Outside Coated? | Belly Seal? | End Seal Quality | Belly Seal Quality |
|---|---|---|---|---|---|---|
| 25 | C2S | 1 | Both | Yes | 3.5 | 3 |
| 30 | C2S | 1 | Both | Yes | 3 | 2 |
| 30 | C2S | 1.5 | Both | Yes | 3 | 3 |

Results of the seal strength testing in this trial indicated that, compared to the initial feasibility trial, the average belly seal rating improved on both the 25 # wrap with 1.0 # of coating and the 30 # wrap with 1.5 # of coating. Both increased from an average rating of 2 to an average rating of 3. The rating on the 30 # wrap with 1.0 # of coating remained the same, with a rating of 2. Thus, the trial was successful in increasing seal strength.

Product sticking rating was also determined in this trial. Once opened, all product was removed from the package and examined for any sticking and/or product damage. Results are shown in Table 11.

TABLE 11

| Basis Weight lbs/ream | C1S or C2S? | Coating Weight lbs/ream | Inside or Outside Coated? | Belly Seal? | Product Sticking |
|---|---|---|---|---|---|
| 25 | C2S | 1 | Both | Yes | 1 |
| 30 | C2S | 1 | Both | Yes | 1 |
| 30 | C2S | 1.5 | Both | Yes | 1 |

Results of the product sticking rating test in this trial indicate that, compared to the initial feasibility trial, the product sticking decreased from an average rating of 2 to an average rating of 1. This is likely due to the decrease in coating weight on the samples (1.0 # of coating vs 1.5 # of coating).

Example 5

A Sheffield smoothness test was conducted by the physical test lab as well. For the 25 #MG paper wrap, the Sheffield Roughness values were 211 Sheff units on the outside surface and 324 Sheff units on the inside surface. For the 30 #MG paper wrap, both sides were rougher, and the Sheffield Roughness value for the outside surface was 251 Sheff units, while the value for the inside surface was 358 Sheff units. This indicated that a minimum coating weight of 1.0 # for the 25 # paper and 1.5 # for the 30 # paper may be preferred. Heavier coating weights may also be feasible as long as the seal bar temperatures are adjusted as needed. Other types of paper which can be made smoother and may run with lower coating weights could potentially be used.

As noted above, in general, this test showed that the 30 # paper is rougher than the 25 # paper (see Table 12 below). Therefore, because there is a significant difference in smoothness between the 25 # and 30 # paper, the 25 # paper, which is smoother, will have a better coating application.

TABLE 12

| Sample | Description | Average Sheffield Roughness, Outside - Sheff Units | Average Sheffield Roughness, Inside - Sheff Units |
|---|---|---|---|
| 1 | 25# Bleached MG Toilet Tissue Overwrap (100% recycled fiber content), with 1.0# HB Fuller Pace® 383, C2S, Printed | 211 | 324 |
| 2 | 30# Bleached MG Toilet Tissue Overwrap (100% recycled fiber content), with 1.0# HB Fuller Pace® 383, C2S, Printed | 251 | 358 |
| 3 | 30# Bleached MG Toilet Tissue Overwrap (100% recycled fiber content), with 1.5# HB Fuller Pace® 383, C2S, Printed | 253 | 353 |

Samples were submitted to the microscopy lab to a) understand the overall performance of the coating, b) understand how much the roughness of the paper affects coating distribution, c) aid in making a recommendation on basis weight, and d) aid in making a recommendation on coating weight. The lab performed three tests on the samples: Scanning Electron Microscopy (SEM), 3D Laser Confocal, and Micro CT Scan.

Utilizing the images captured through the SEM, both the roughness of the paper and the application of the coating were observed between the 25 # and 30 # paper. The 25 # paper was smoother and had a better application and distribution of coating as there was less contrast in the topography of the image. The 30 # paper had a lot more contrast and noticeable fibers and speckles that indicated, from a qualitative perspective, that the coating application was less consistently distributed. Qualitatively, it appears that the 25 #/1.0 # sample showed slightly improved coating. There was not a noticeable difference between the 1.0 # and 1.5 # coating using SEM.

Through the images and topography captured with the 3D laser confocal and the micro-CT scan, there appeared to be a minimal qualitative difference between structure of two samples. There was a larger degree of spacing observed in the 30 #/1.0 # sample between layers.

Key takeaways from this trial included the following: (1) smoother paper with a heavier adhesive coating leads to stronger belly and end seals, (2) there were minimal runnability issues on the 25 # paper, and (3) there were runnability issues on the 30 # paper due to the hard wrinkles.

We claim:

1. A paper wrapped product comprising:

a product covered in a paper wrap;

the product having a top surface, a bottom surface, and at least one side surface;

the paper wrap having an inside surface and an outside surface; wherein at least one portion of the outside surface of the paper wrap is coated with at least one heat-sealable adhesive;

wherein the paper wrap covers the product such that a first portion of the outside surface of the paper wrap is folded back to overlay a second portion of the outside surface of the paper wrap at a position covering the top surface of the product, a third portion of the outside surface of the paper wrap is folded back to overlay a fourth portion of the outside surface of the paper wrap at a position covering the bottom surface of the product, and a first portion of the inside surface of the paper wrap overlays a fifth portion of the outside surface of the paper wrap at a position covering the at least one side surface of the product; and wherein at least one of the first and second portions of the outside surface of the paper wrap is coated with at least one first heat-sealable adhesive bonding the first and second portions together, at least one of the third and fourth portions of the outside surface of the paper wrap is coated with at least one second heat-sealable adhesive bonding the third and fourth portions together, and the fifth portion of the outside surface of the paper wrap is coated with at least one third heat-sealable adhesive bonding the fifth portion of the outside surface of the paper wrap to the first portion of the inside surface of the paper wrap; and wherein the portions of the outside surface of the paper wrap coated with the at least one first heat-sealable adhesive, at least one second heat-sealable adhesive, and at least one third heat-sealable adhesive make up a total coated area of the outside surface of the paper wrap, and wherein less than about 35% of the total coated area of the outside surface of the paper wrap remains exposed on the outside of the paper wrapped product.

2. The paper wrapped product of claim 1, wherein the product comprises at least one paper towel roll or bath tissue roll.

3. The paper wrapped product of claim 1, wherein the product is an individually wrapped paper towel roll or bath tissue roll.

4. The paper wrapped product of claim 1, wherein the product is an individually wrapped coreless paper towel or bath tissue roll.

5. The paper wrapped product of claim 1, wherein the product comprises a bundle of paper towel or bath tissue rolls.

6. The paper wrapped product of claim 1, wherein the product comprises a bundle of coreless paper towel or bath tissue rolls.

7. The paper wrapped product of claim 1, wherein the portions of the outside surface of the paper wrap coated with the at least one first heat-sealable adhesive, at least one second heat-sealable adhesive, and at least one third heat-sealable adhesive make up a total coated area of the outside surface of the paper wrap, and wherein less than about 5% of the total coated area of the at least one first heat-sealable adhesive, at least one second heat-sealable adhesive, and at least one third heat-sealable adhesive remains exposed on the outside of the paper wrapped product.

8. The paper wrapped product of claim 1, wherein each of the at least one first heat-sealable adhesive, the at least one second heat-sealable adhesive, and the at least one third heat-sealable adhesive is a non-wax adhesive that comprises a heat-sealable polyvinyl alcohol polyvinyl acetate.

9. The paper wrapped product of claim 1, wherein the at least one first heat-sealable adhesive and the at least one second heat-sealable adhesive are the same as each other and different from the at least one third heat-sealable adhesive.

10. The paper wrapped product of claim 1, wherein the portions of the outside surface of the paper wrap coated with the at least one first heat-sealable adhesive, at least one second heat-sealable adhesive, and at least one third heat-sealable adhesive make up a total coated area of the outside surface of the paper wrap, and wherein the total coated area of the at least one first heat-sealable adhesive, the at least one second heat-sealable adhesive, and the at least one third heat-sealable adhesive covers between about 35% and about 65% of the outside surface of the paper wrap.

11. The paper wrapped product of claim 1, wherein the at least one first heat-sealable adhesive and the at least one second heat-sealable adhesive are each coated on areas of the paper wrap in a pattern providing from about 40% coverage to about 60% coverage of the coated areas.

12. The paper wrapped product of claim 11, wherein the at least one third heat-sealable adhesive is coated on an area of the paper wrap in a pattern providing substantially 100% coverage of the coated area.

13. The paper wrapped product of claim 1, wherein each of the first and second portions of the outside surface of the paper wrap are coated with the at least one first heat-sealable adhesive and each of the third and fourth portions of the outside surface of the paper wrap are coated with the at least one second heat-sealable adhesive.

14. The paper wrapped product of claim 13, wherein the first portion of the inside surface of the paper wrap is also coated with at least one heat-sealable adhesive.

15. The paper wrapped product of claim 14, wherein the outside surface of the paper wrap is further printed with ink in the form of decorative elements, patterns, informational markings, eye marks, or combinations thereof.

16. The paper wrapped product of claim 3, wherein the bond between the first and second portions of the outside surface of the paper wrap and the bond between the third and fourth portions of the outside surface of the paper wrap each have a max load seal strength of between about 75 $g_f$/inch width to about 150 $g_f$/inch width, and the bond between the fifth portion of the outside surface of the paper wrap and the first portion of the inside surface of the paper wrap has a max load seal strength of between about 8 $g_f$/inch width and about 50 $g_f$/inch width.

17. The paper wrapped product of claim 3, wherein the bond between the first and second portions of the outside surface of the paper wrap, the bond between the third and fourth portions of the outside surface of the paper wrap, and the bond between the fifth portion of the outside surface of the paper wrap and the first portion of the inside surface of the paper wrap each have a max load seal strength of between about 75 $g_f$/inch width and about 150 $g_f$/inch width.

18. The paper wrapped product of claim 3, wherein the paper wrap has a basis weight, and wherein the basis weight is between about 12 lbs/3000 $ft^2$ to about 20 lbs/3000 $ft^2$.

19. The paper wrapped product of claim 3, wherein each of the at least one first heat-sealable adhesive, the at least one second heat-sealable adhesive, and the at least one third heat-sealable adhesive is applied at a dry coating weight of from about 0.2 lbs/3000 $ft^2$ to about 1 lb/3000 $ft^2$.

20. The paper wrapped product of claim 3, wherein each of the at least one first heat-sealable adhesive, the at least one second heat-sealable adhesive, and the at least one third heat-sealable adhesive is applied at a dry coating weight of from about 0.25 lbs/3000 $ft^2$ to about 0.5 lbs/3000 $ft^2$.

21. The paper wrapped product of claim 5, wherein the bond between the first and second portions of the outside surface of the paper wrap, the bond between the third and fourth portions of the outside surface of the paper wrap, and the bond between the fifth portion of the outside surface of the paper wrap and the first portion of the inside surface of the paper wrap each have a max load seal strength of between about 150 $g_f$/inch width and about 800 $g_f$/inch width.

22. The paper wrapped product of claim 21, wherein the max load seal strength is between about 200 $g_f$/inch width and about 400 $g_f$/inch width.

23. The paper wrapped product of claim 5, wherein the paper wrap has a basis weight, and wherein the basis weight is between about 20 lbs/3000 $ft^2$ to about 30 lbs/3000 $ft^2$.

24. The paper wrapped product of claim 5, wherein each of the at least one first heat-sealable adhesive, the at least one second heat-sealable adhesive, and the at least one third heat-sealable adhesive is applied at a dry coating weight of from about 0.25 lbs/3000 $ft^2$ to about 3 lbs/3000 $ft^2$.

25. The paper wrapped product of claim 5, wherein each of the at least one first heat-sealable adhesive, the at least one second heat-sealable adhesive, and the at least one third heat-sealable adhesive is applied at a dry coating weight of from about 0.5 lbs/3000 $ft^2$ to about 1.25 lbs/3000 $ft^2$.

26. The paper wrapped product of claim 1, wherein each of the at least one first heat-sealable adhesive, the at least one second heat-sealable adhesive, and the at least one third heat-sealable adhesive is heat-sealed at a temperature of between about 200° F. to about 700° F.

* * * * *